US008279037B2

(12) United States Patent
Yan et al.

(10) Patent No.: US 8,279,037 B2
(45) Date of Patent: Oct. 2, 2012

(54) MAGNETIC COMPONENTS AND METHODS OF MANUFACTURING THE SAME

(75) Inventors: Yipeng Yan, Shanghai (CN); Robert James Bogert, Lake Worth, FL (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 12/508,279

(22) Filed: Jul. 23, 2009

(65) Prior Publication Data

US 2010/0007457 A1 Jan. 14, 2010

Related U.S. Application Data

(63) Continuation-in-part of application No. 12/181,436, filed on Jul. 29, 2008.

(60) Provisional application No. 61/175,269, filed on May 4, 2009, provisional application No. 61/080,115, filed on Jul. 11, 2008.

(51) Int. Cl.
*H01F 27/24* (2006.01)

(52) U.S. Cl. ..... 336/233; 336/234

(58) Field of Classification Search ..... 336/233, 336/234

See application file for complete search history.

(56) References Cited

U.S. PATENT DOCUMENTS

| | | | | |
|---|---|---|---|---|
| 2,391,563 | A | | 12/1945 | Goldberg |
| 3,255,512 | A | | 6/1966 | Lochner et al. |
| 4,072,780 | A | | 2/1978 | Zillman |
| 4,313,152 | A | | 1/1982 | Vranken |
| 4,322,698 | A | * | 3/1982 | Takahashi et al. ..... 333/184 |
| 4,543,553 | A | | 9/1985 | Mandai et al. |
| 4,689,594 | A | | 8/1987 | Kawabata et al. |
| 4,750,077 | A | | 6/1988 | Amagasa |
| 4,758,808 | A | | 7/1988 | Sasaki et al. |
| 4,803,425 | A | | 2/1989 | Swanberg |
| 4,873,757 | A | | 10/1989 | Williams |
| 5,032,815 | A | | 7/1991 | Kobayashi et al. |
| 5,045,380 | A | | 9/1991 | Kobayashi et al. |
| 5,250,923 | A | | 10/1993 | Ushiro et al. |
| 5,257,000 | A | | 10/1993 | Billings et al. |
| 5,300,911 | A | | 4/1994 | Walters |
| 5,463,717 | A | | 10/1995 | Takatori et al. |
| 5,515,022 | A | | 5/1996 | Tashiro et al. |
| 5,532,667 | A | | 7/1996 | Haertling et al. |
| 5,572,180 | A | | 11/1996 | Huang et al. |
| 5,664,069 | A | | 9/1997 | Takatori et al. |
| 5,761,791 | A | | 6/1998 | Bando |
| 5,821,638 | A | | 10/1998 | Boys et al. |
| 5,849,355 | A | | 12/1998 | McHenry |

(Continued)

FOREIGN PATENT DOCUMENTS

DE 8132269 U1 11/1985

(Continued)

OTHER PUBLICATIONS

International Search Report and Written Opinion of PCT/US2009/057471; Dec. 14, 2009; 14 pages.

(Continued)

*Primary Examiner* — Mohamad Musleh
*Assistant Examiner* — Ronald Hinson
(74) *Attorney, Agent, or Firm* — Armstrong Teasdale LLP

(57) ABSTRACT

Magnetic component assemblies and core structures including coil coupling arrangements, that are advantageously utilized in providing surface mount magnetic components such as inductors and transformers.

34 Claims, 29 Drawing Sheets

U.S. PATENT DOCUMENTS 5,875,541 A 3/1999 Kumeji et al.
5,945,902 A 8/1999 Lipkes et al.
6,038,134 A 3/2000 Belter
6,054,914 A 4/2000 Abel et al.
6,169,801 B1 1/2001 Levasseur et al.
6,198,374 B1 3/2001 Abel
6,198,375 B1 3/2001 Shafer
6,204,744 B1 3/2001 Shafer et al.
6,287,931 B1 9/2001 Chen
6,293,001 B1 9/2001 Uriu et al.
6,366,192 B2 4/2002 Person et al.
6,379,579 B1 4/2002 Harada
6,420,953 B1 7/2002 Dadafshar
6,449,829 B1 9/2002 Shafer
6,460,244 B1 10/2002 Shafer et al.
6,566,731 B2 5/2003 Ahn et al.
6,628,531 B2 9/2003 Dadafshar
6,631,545 B1 10/2003 Uriu et al.
6,653,196 B2 11/2003 Ahn et al.
6,658,724 B2 12/2003 Nakano et al.
6,710,692 B2 3/2004 Kato et al.
6,713,162 B2 3/2004 Takaya et al.
6,720,074 B2 4/2004 Zhang et al.
6,749,827 B2 6/2004 Smalley et al.
6,750,723 B2 6/2004 Yoshida et al.
6,791,445 B2 9/2004 Shibata et al.
6,794,052 B2 9/2004 Schultz et al.
6,797,336 B2 9/2004 Garvey et al.
6,808,642 B2 10/2004 Takaya et al.
6,817,085 B2 11/2004 Uchikoba et al.
6,835,889 B2 * 12/2004 Hiraoka et al. ..... 174/521
6,864,201 B2 3/2005 Schultz et al.
6,879,238 B2 4/2005 Liu et al.
6,882,261 B2 4/2005 Moro et al.
6,885,276 B2 4/2005 Iha et al.
6,897,718 B2 5/2005 Yoshida et al.
6,908,960 B2 6/2005 Takaya et al.
6,927,738 B2 8/2005 Senba et al.
6,936,233 B2 8/2005 Smalley et al.
6,946,944 B2 9/2005 Shafer et al.
6,949,237 B2 9/2005 Smalley et al.
6,952,355 B2 10/2005 Riggio et al.
6,971,391 B1 12/2005 Wang et al.
6,979,709 B2 12/2005 Smalley et al.
6,986,876 B2 1/2006 Smalley et al.
7,008,604 B2 3/2006 Smalley et al.
7,019,391 B2 3/2006 Tran
7,034,091 B2 4/2006 Schultz et al.
7,034,645 B2 4/2006 Shafer et al.
7,041,620 B2 5/2006 Smalley et al.
7,048,999 B2 5/2006 Smalley et al.
7,069,639 B2 7/2006 Choi et al.
7,071,406 B2 7/2006 Smalley et al.
7,078,999 B2 7/2006 Uriu et al.
7,081,803 B2 7/2006 Takaya et al.
7,087,207 B2 8/2006 Smalley et al.
7,091,412 B2 8/2006 Wang et al.
7,091,575 B2 8/2006 Ahn et al.
7,105,596 B2 9/2006 Smalley et al.
7,108,841 B2 9/2006 Smalley et al.
7,127,294 B1 10/2006 Wang et al.
7,142,066 B1 11/2006 Hannah et al.
7,162,302 B2 1/2007 Wang et al.
7,187,263 B2 3/2007 Vinciarelli
7,205,069 B2 4/2007 Smalley et al.
7,213,915 B2 5/2007 Tsutsumi et al.
7,221,249 B2 5/2007 Shafer et al.
7,262,482 B2 8/2007 Ahn et al.
7,263,761 B1 9/2007 Shafer et al.
7,294,366 B2 11/2007 Renn et al.
7,319,599 B2 1/2008 Hirano et al.
7,330,369 B2 2/2008 Tran
7,339,451 B2 3/2008 Liu et al.
7,345,562 B2 3/2008 Shafer et al.
7,354,563 B2 4/2008 Smalley et al.
7,375,417 B2 5/2008 Tran
7,380,328 B2 6/2008 Ahn et al.
7,390,477 B2 6/2008 Smalley et al.
7,390,767 B2 6/2008 Smalley et al.
7,393,699 B2 7/2008 Tran
7,400,512 B2 7/2008 Hirano et al.
7,419,624 B1 9/2008 Smalley et al.
7,419,651 B2 9/2008 Smalley et al.
7,442,665 B2 10/2008 Schultz et al.
7,445,852 B2 11/2008 Maruko et al.
7,481,989 B2 1/2009 Smalley et al.
7,485,366 B2 2/2009 Ma et al.
7,489,537 B2 2/2009 Tran
7,567,163 B2 7/2009 Dadafshar et al.
2001/0016977 A1 8/2001 Moro et al.
2002/0009577 A1 * 1/2002 Takaya et al. ..... 428/209
2002/0067234 A1 6/2002 Kung
2002/0121957 A1 9/2002 Takashima et al.
2004/0113741 A1 * 6/2004 Li et al. ..... 336/212
2004/0174239 A1 9/2004 Shibata et al.
2005/0012581 A1 1/2005 Ono et al.
2005/0151614 A1 7/2005 Dadafshar
2006/0001517 A1 1/2006 Cheng
2006/0038651 A1 2/2006 Mizushima et al.
2006/0145804 A1 7/2006 Matsuani et al.
2007/0030108 A1 * 2/2007 Ishimoto et al. ..... 336/200
2007/0057755 A1 3/2007 Suzuki et al.
2007/0163110 A1 7/2007 Sutradja
2008/0001702 A1 1/2008 Brunner
2008/0012679 A1 1/2008 Okabe et al.
2008/0061917 A1 3/2008 Manoukian et al.
2008/0110014 A1 5/2008 Shafer et al.
2008/0310051 A1 12/2008 Yan et al.
2010/0026443 A1 2/2010 Yan et al.
2010/0039200 A1 2/2010 Yan et al.

FOREIGN PATENT DOCUMENTS

EP 0655754 A1 5/1995
EP 1564761 A1 8/2005
EP 1833063 A1 9/2007
EP 1833063 A9 9/2007
FR 2556493 A1 6/1985
GB 2044550 A 10/1980
JP 1266705 A 10/1989
JP 07272932 10/1995
JP 2700713 1/1998
JP 10106839 4/1998
JP 3108931 11/2000
JP 3160685 4/2001
JP 2007227914 A 9/2007
JP 2008074178 A 4/2008
KR 20010014533 2/2001
KR 20020071285 9/2002
KR 20030081738 10/2003
WO 9205568 4/1992
WO 2005024862 A1 3/2005
WO 2006063081 A2 6/2006
WO 2009113775 A2 9/2009

OTHER PUBLICATIONS

International Search Report and Written Opinion of PCT/US2009/051005; Sep. 23, 2009; 15 pages.
International Search Report and Written Opinion of PCT/US2010/032540; Jul. 27, 2010; 20 pages.
International Search Report and Written Opinion of PCT/US2010/032407; Aug. 2, 2010; 19 pages.
Office Action of U.S. Appl. No. 12/551,028 dated Dec. 8, 2010; 13 pages.

* cited by examiner

Simulation vs. Test of 2-phase CPL

DISCRETE FERRITE CORE DISTRIBUTED GAP CORE

- G means gap
- A means area

| | Core Material | OCL (nH) | | SCL/phase (nH) | Ui |
|---|---|---|---|---|---|
| | | Phase #1 | Phase #2 | | |
| Simulation | Ferrite | 192 | 192 | 54.5 | 1300 |
| Simulation | Powder | 191.2 | 191.2 | 174 | 106 |
| Test | Ferrite | 190 | 190 | 55 | 1300 |

- *If only change discrete ferrite core to distributed gap core without winding position change, there is low coupling between two phases.*

- *With A1 increase and A2 decrease, the coupling becomes better.*

- *Once winding physical position is fixed, the OCL/SCL will not change too much at different Ue. That means the coupling will not change also.*

*With A2 increase and A3 decrease, the coupling become better.*

Simulation vs. Test Data of MCPL-3

| | OCL (nH) | | | SCL/phase (nH) | Ue |
|---|---|---|---|---|---|
| | Phase #1 | Phase #2 | Phase #3 | | |
| Simulation | 160 | 162 | 160 | 137 | 47 |
| Test | 166 | 182 | 162 | 113 | N/A |

Molded Amorphous Coupled Inductor

Summary

- For discrete ferrite type CPL, the coupling is controlled by Air Gaps.
- For distributed gap type CPL, the coupling is controlled by Cross Section Areas.

MULTI-PHASE INDUCTOR

TWO PHASE SHOWN

WINDING WINDOW CONTAINS HALF TURNS

PCB FOOTPRINT PROVIDES THE OTHER HALF TURNS

TOTAL NUMBER OF TURNS DEFINED BY PCB LAYOUT

MAGNETIC COMPONENTS AND METHODS OF MANUFACTURING THE SAME

CROSS REFERENCE TO RELATED APPLICATIONS

This application claims the benefit of U.S. Provisional Patent Application Nos. 61/175,269 filed May 4, 2009 and 61/080,115 filed Jul. 11, 2008, and is a continuation in part application of U.S. application Ser. No. 12/181,436 filed Jul. 29, 2008, the disclosures of which are hereby incorporated by reference in their entirety.

The present application also relates to subject matter disclosed in the following commonly owned and co-pending patent applications: U.S. patent application Ser. No. 12/429,856 filed Apr. 24, 2009 and entitled "Surface Mount Magnetic Component Assembly"; U.S. patent application Ser. No. 12/247,281 filed on Oct. 8, 2008 and entitled "High Current Amorphous Powder Core Inductor"; U.S. patent application Ser. No. 12/138,792 filed Jun. 13, 2008 and entitled "Miniature Shielded Magnetic Component"; and U.S. patent application Ser. No. 11/519,349 filed Jun. Sep. 12, 2006 and entitled "Low Profile Layered Coil and Cores for Magnetic Components".

BACKGROUND OF THE INVENTION

The field of the invention relates generally to magnetic components and their manufacture, and more specifically to magnetic, surface mount electronic components such as inductors and transformers.

With advancements in electronic packaging, the manufacture of smaller, yet more powerful, electronic devices has become possible. To reduce an overall size of such devices, electronic components used to manufacture them have become increasingly miniaturized. Manufacturing electronic components to meet such requirements presents many difficulties, thereby making manufacturing processes more expensive, and undesirably increasing the cost of the electronic components.

Manufacturing processes for magnetic components such as inductors and transformers, like other components, have been scrutinized as a way to reduce costs in the highly competitive electronics manufacturing business. Reduction of manufacturing costs is particularly desirable when the components being manufactured are low cost, high volume components. In high volume, mass production processes for such components, and also electronic devices utilizing the components, any reduction in manufacturing costs is, of course, significant.

BRIEF DESCRIPTION OF THE INVENTION

Exemplary embodiments of magnetic component assemblies and methods of manufacturing the assemblies are disclosed herein that are advantageously utilized to achieve one or more of the following benefits: component structures that are more amenable to produce at a miniaturized level; component structures that are more easily assembled at a miniaturized level; component structures that allow for elimination of manufacturing steps common to known magnetic component constructions; component structures having an increased reliability via more effective manufacturing techniques; component structures having improved performance in similar or reduced package sizes compared to existing magnetic components; component structures having increased power capability compared to conventional, miniaturized, magnetic components; and component structures having unique core and coil constructions offering distinct performance advantages relative to known magnetic component constructions.

The exemplary component assemblies are believed to be particularly advantageous to construct inductors and transformers, for example. The assemblies may be reliably provided in small package sizes and may include surface mount features for ease of installation to circuit boards.

BRIEF DESCRIPTION OF THE DRAWINGS

Non-limiting and non-exhaustive embodiments are described with reference to the following Figures, wherein like reference numerals refer to like parts throughout the various drawings unless otherwise specified.

DETAILED DESCRIPTION OF THE INVENTION

Figure 1:
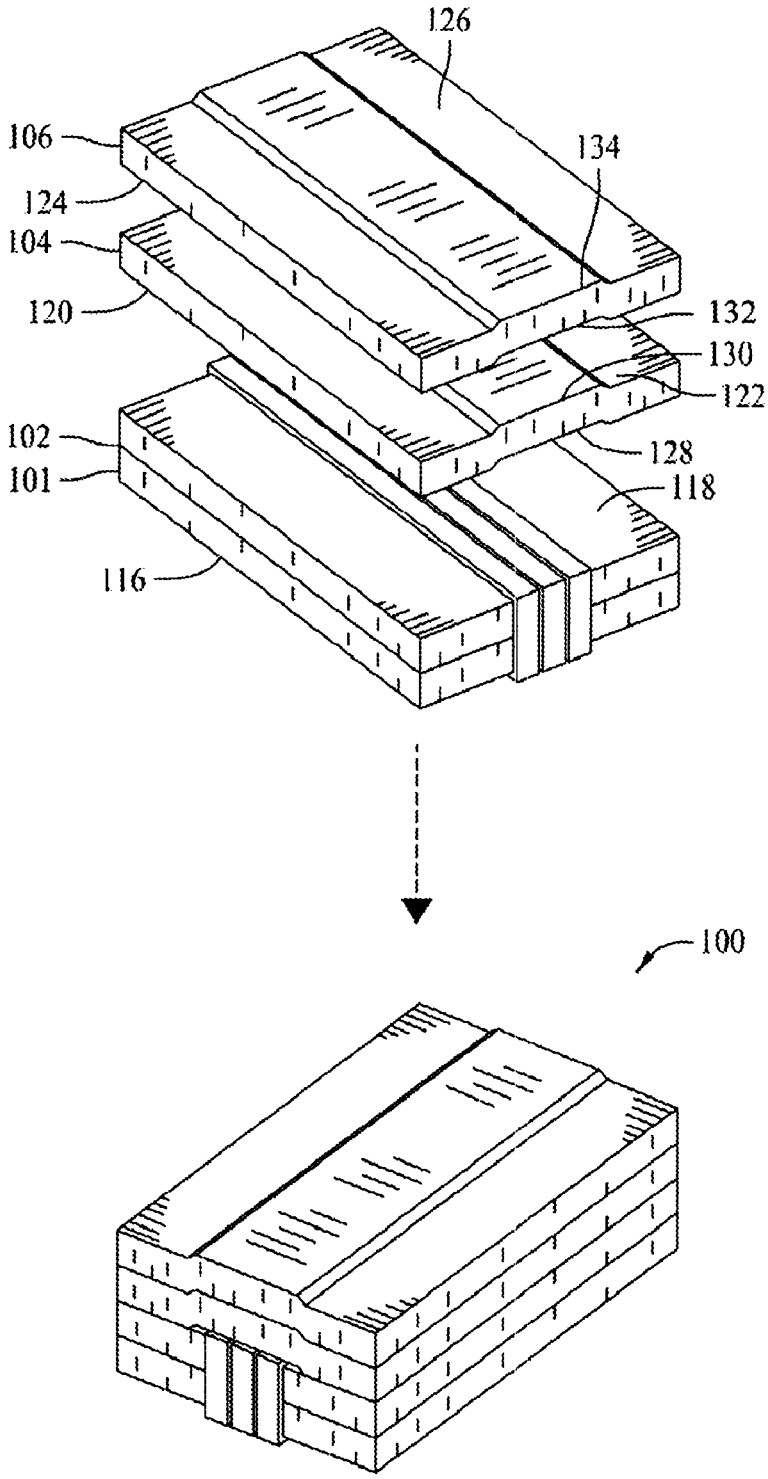
FIG. 1 illustrates a perspective view and an exploded view of the top side of a miniature power inductor in accordance with an exemplary embodiment of the invention.

Exemplary embodiments of inventive electronic component designs are described herein that overcome numerous difficulties in the art. To understand the invention to its fullest extent, the following disclosure is presented in different segments or parts, wherein Part I discusses particular problems and difficulties, and Part II describes exemplary component constructions and assemblies for overcoming such problems.

I. Introduction to the Invention

Conventional magnetic components such as inductors for circuit board applications typically include a magnetic core and a conductive winding, sometimes referred to as a coil, within the core. The core may be fabricated from discrete core pieces fabricated from magnetic material with the winding placed between the core pieces. Various shapes and types of core pieces and assemblies are familiar to those in the art, including but not necessarily limited to U core and I core assemblies, ER core and I core assemblies, ER core and ER core assemblies, a pot core and T core assemblies, and other matching shapes. The discrete core pieces may be bonded together with an adhesive and typically are physically spaced or gapped from one another.

In some known components, for example, the coils are fabricated from a conductive wire that is wound around the core or a terminal clip. That is, the wire may be wrapped around a core piece, sometimes referred to as a drum core or other bobbin core, after the core pieces has been completely formed. Each free end of the coil may be referred to as a lead and may be used for coupling the inductor to an electrical circuit, either via direct attachment to a circuit board or via an indirect connection through a terminal clip. Especially for small core pieces, winding the coil in a cost effective and reliable manner is challenging. Hand wound components tend to be inconsistent in their performance. The shape of the core pieces renders them quite fragile and prone to core cracking as the coil is wound, and variation in the gaps between the core pieces can produce undesirable variation in component performance. A further difficulty is that the DC resistance ("DCR") may undesirably vary due to uneven winding and tension during the winding process.

In other known components, the coils of known surface mount magnetic components are typically separately fabricated from the core pieces and later assembled with the core pieces. That is, the coils are sometimes referred to as being pre-formed or pre-wound to avoid issues attributable to hand winding of the coil and to simplify the assembly of the magnetic components. Such pre-formed coils are especially advantageous for small component sizes.

In order to make electrical connection to the coils when the magnetic components are surface mounted on a circuit board, conductive terminals or clips are typically provided. The clips are assembled on the shaped core pieces and are electrically connected to the respective ends of the coil. The terminal clips typically include generally flat and planar regions that may be electrically connected to conductive traces and pads on a circuit board using, for example, known soldering techniques. When so connected and when the circuit board is energized, electrical current may flow from the circuit board to one of the terminal clips, through the coil to the other of the terminal clips, and back to the circuit board. In the case of an inductor, current flow through the coil induces magnetic fields and energy in the magnetic core. More than one coil may be provided.

In the case of a transformer, a primary coil and a secondary coil are provided, wherein current flow through the primary coil induces current flow in the secondary coil. The manufacture of transformer components presents similar challenges as inductor components.

For increasingly miniaturized components, providing physically gapped cores is challenging. Establishing and maintaining consistent gap sizes is difficult to reliably accomplish in a cost effective manner.

A number of practical issues are also presented with regard to making the electrical connection between the coils and the terminal clips in miniaturized, surface mount magnetic components. A rather fragile connection between the coil and terminal clips is typically made external to the core and is consequently vulnerable to separation. In some cases, it is known to wrap the ends of coil around a portion of the clips to ensure a reliable mechanical and electrical connection between the coil and the clips. This has proven tedious, however, from a manufacturing perspective and easier and quicker termination solutions would be desirable. Additionally, wrapping of the coil ends is not practical for certain types of coils, such as coils having rectangular cross section with flat surfaces that are not as flexible as thin, round wire constructions.

As electronic devices continue recent trends of becoming increasingly powerful, magnetic components such as inductors are also required to conduct increasing amounts of current. As a result the wire gauge used to manufacture the coils is typically increased. Because of the increased size of the wire used to fabricate the coil, when round wire is used to fabricate the coil the ends are typically flattened to a suitable thickness and width to satisfactorily make the mechanical and electrical connection to the terminal clips using for example, soldering, welding, or conductive adhesives and the like. The larger the wire gauge, however, the more difficult it is to flatten the ends of the coil to suitably connect them to the terminal clips. Such difficulties have resulted in inconsistent connections between the coil and the terminal clips that can lead to undesirable performance issues and variation for the magnetic components in use. Reducing such variation has proven very difficult and costly.

Fabricating the coils from flat, rather than round conductors may alleviate such issues for certain applications, but flat conductors tend to be more rigid and more difficult to form into the coils in the first instance and thus introduce other manufacturing issues. The use of flat, as opposed to round, conductors can also alter the performance of the component in use, sometimes undesirably. Additionally, in some known constructions, particularly those including coils fabricated from flat conductors, termination features such as hooks or other structural features may be formed into the ends of the coil to facilitate connections to the terminal clips. Forming such features into the ends of the coils, however, can introduce further expenses in the manufacturing process.

Recent trends to reduce the size, yet increase the power and capabilities of electronic devices present still further challenges. As the size of electronic devices are decreased, the size of the electronic components utilized in them must accordingly be reduced, and hence efforts have been directed to economically manufacture power inductors and transformers having relatively small, sometimes miniaturized, structures despite carrying an increased amount of electrical current to power the device. The magnetic core structures are desirably provided with lower and lower profiles relative to circuit boards to allow slim and sometimes very thin profiles of the electrical devices. Meeting such requirement presents still further difficulties. Still other difficulties are presented for components that are connected to multi-phase electrical power systems, wherein accommodating different phases of electrical power in a miniaturized device is difficult.

Efforts to optimize the footprint and the profile of magnetic components are of great interest to component manufacturers looking to meet the dimensional requirements of modern electronic devices. Each component on a circuit board may be generally defined by a perpendicular width and depth dimension measured in a plane parallel to the circuit board, the product of the width and depth determining the surface area occupied by the component on the circuit board, sometimes referred to as the "footprint" of the component. On the other hand, the overall height of the component, measured in a direction that is normal or perpendicular to the circuit board, is sometimes referred to as the "profile" of the component. The footprint of the components in part determines how many components may be installed on a circuit board, and the profile in part determines the spacing allowed between parallel circuit boards in the electronic device. Smaller electronic devices generally require more components to be installed on each circuit board present, a reduced clearance between adjacent circuit boards, or both.

However, many known terminal clips used with magnetic components have a tendency to increase the footprint and/or the profile of the component when surface mounted to a circuit board. That is, the clips tend to extend the depth, width and/or height of the components when mounted to a circuit board and undesirably increase the footprint and/or profile of the component. Particularly for clips that are fitted over the external surfaces of the magnetic core pieces at the top, bottom or side portions of the core, the footprint and/or profile of the completed component may be extended by the terminal clips. Even if the extension of the component profile or height is relatively small, the consequences can be substantial as the number of components and circuit boards increases in any given electronic device.

II. Exemplary Inventive Magnetic Component Assemblies and Methods of Manufacture.

Exemplary embodiments of magnetic component assemblies will now be discussed that address some of the problems of conventional magnetic components in the art. For discussion purposes, exemplary embodiments of the component assemblies and methods of manufacture are discussed collectively in relation to common design features addressing specific concerns in the art.

Manufacturing steps associated with the devices described are in part apparent and in part specifically described below. Likewise, devices associated with method steps described are in part apparent and in part explicitly described below. That is the devices and methodology of the invention will not necessarily be separately described in the discussion below, but are believed to be well within the purview of those in the art without further explanation.

Figure 2:
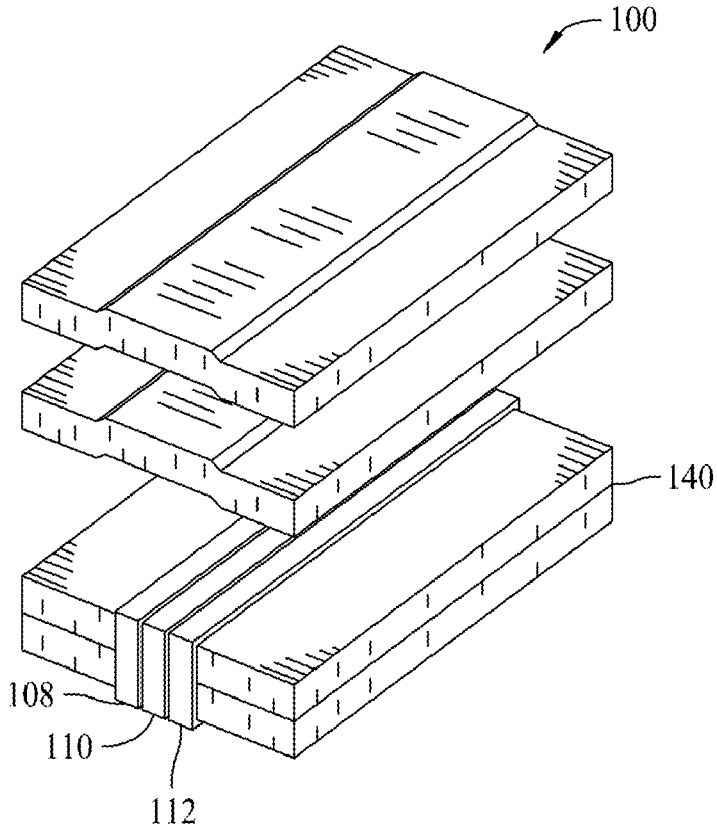
FIG. 2 illustrates a perspective view of the top side of the miniature power inductor as depicted in FIG. 1 during an intermediate manufacturing step in accordance with an exemplary embodiment.
Figure 3:
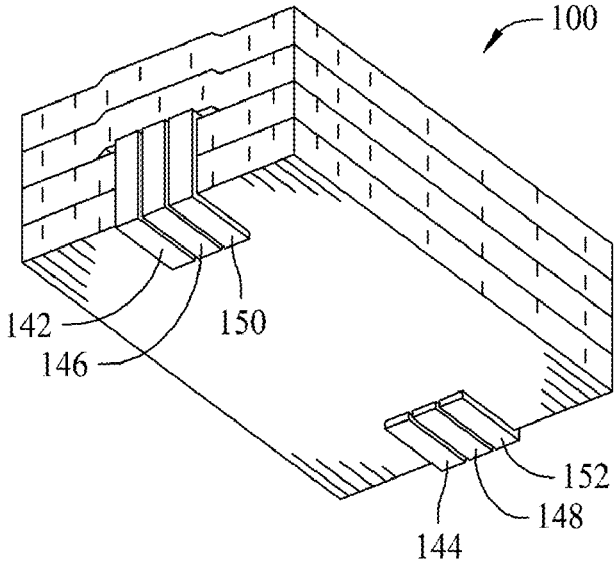
FIG. 3 illustrates a perspective view of the bottom side of the miniature power inductor as depicted in FIG. 1 in accordance with an exemplary embodiment.
Figure 4:
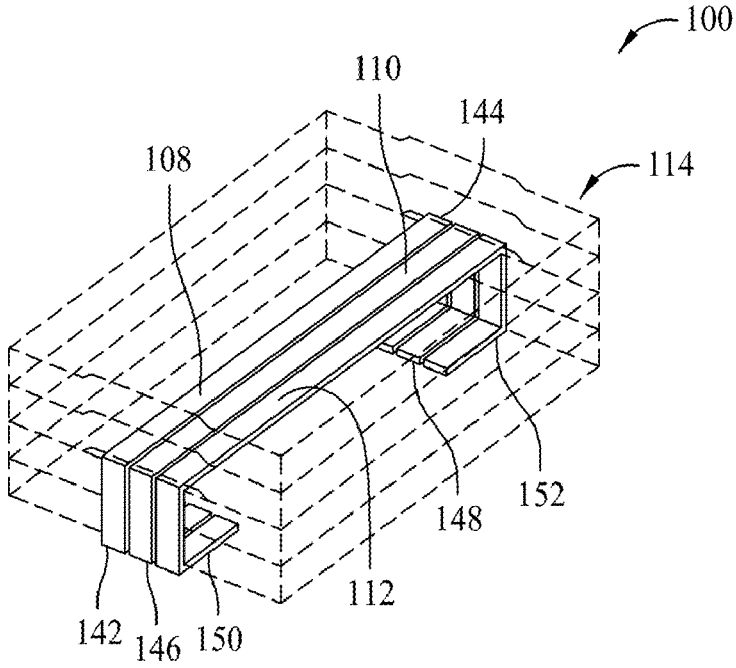
FIG. 4 illustrates a perspective view of an exemplary winding configuration for the miniature power inductor as depicted in FIG. 1, FIG. 2, and FIG. 3 in accordance with an exemplary embodiment.

Referring to FIGS. 1-4, several views of an exemplary embodiment of a magnetic component or device 100 are shown. FIG. 1 illustrates a perspective view and an exploded view of the top side of a miniature power inductor having a three turn clip winding in an exemplary winding configuration, at least one magnetic powder sheet, and a horizontally oriented core area in accordance with an exemplary embodiment. FIG. 2 illustrates a perspective view of the top side of the miniature power inductor as depicted in FIG. 1 during an intermediate manufacturing step in accordance with an exemplary embodiment. FIG. 3 illustrates a perspective view of the bottom side of the miniature power inductor as depicted in FIG. 1 in accordance with an exemplary embodiment. FIG. 4 illustrates a perspective view of a winding configuration of the miniature power inductor as depicted in FIG. 1, FIG. 2, and FIG. 3 in accordance with an exemplary embodiment.

According to this embodiment, the miniature power inductor 100 comprises a magnetic body including at least one magnetic powder sheet 101, 102, 104, 106 and a plurality of coils or windings 108, 110, 112, which each may be in the form of a clip, coupled to the at least one magnetic powder sheet 101, 102, 104, 106 in a winding configuration 114. As seen in this embodiment, the miniature power inductor 100 comprises a first magnetic powder sheet 101 having a lower surface 116 and an upper surface opposite the lower surface, a second magnetic powder sheet 102 having a lower surface and an upper surface 118 opposite the lower surface, a third magnetic powder sheet 104 having a lower surface 120 and an upper surface 122, and a fourth magnetic powder sheet 106 having a lower surface 124 and an upper surface 126.

The magnetic layers 101, 102, 104 and 106 may be provided in relatively thin sheets that may be stacked with the coils or windings 108, 110, 112 and joined to one another in a lamination process or via other techniques known in the art. The magnetic layers 101, 102, 104 and 106 may be prefabricated at a separate stage of manufacture to simplify the formation of the magnetic component at a later assembly stage. The magnetic material is beneficially moldable into a desired shape through, for example, compression molding techniques or other techniques to couple the magnetic layers to the coils and to define the magnetic body into a desired shape. The ability to mold the magnetic material is advantageous in that the magnetic body can be formed around the coils 108, 110, 112 in an integral or monolithic structure including the coil, and a separate manufacturing step of assembling the coil(s) to a magnetic structure is avoided. Various shapes of magnetic bodies may be provided in various embodiments.

In an exemplary embodiment, each magnetic powder sheet may be, for example, a magnetic powder sheet manufactured by Chang Sung Incorporated in Incheon, Korea and sold under product number 20u-eff Flexible Magnetic Sheet. Also, these magnetic powder sheets have grains which are dominantly oriented in a particular direction. Thus, a higher inductance may be achieved when the magnetic field is created in the direction of the dominant grain orientation. Although this embodiment depicts four magnetic powder sheets, the number of magnetic sheets may be increased or reduced so as to increase or decrease the core area without departing from the scope and spirit of the exemplary embodiment. Also, although this embodiment depicts a magnetic powder sheet, any flexible sheet may be used that is capable of being laminated may alternatively be used, without departing from the scope and spirit of the exemplary embodiment.

In further and/or alternative embodiments, the magnetic sheets or layers 101, 102, 104, and 106 may be fabricated from the same type of magnetic particles or different types of magnetic particles. That is, in one embodiment, all the magnetic layers 101, 102, 104, and 106 may be fabricated from one and the same type of magnetic particles such that the layers 101, 102, 104, and 106 have substantially similar, if not identical, magnetic properties. In another embodiment, however, one or more of the layers 101, 102, 104, and 106 could be fabricated from a different type of magnetic powder particle than the other layers. For example, the inner magnetic layers 104 and 106 may include a different type of magnetic particles than the outer magnetic layers 101 and 106, such that the inner layers 104 and 106 have different properties from the outer magnetic layers 101 and 106. The performance characteristics of completed components may accordingly be varied depending on the number of magnetic layers utilized and the type of magnetic materials used to form each of the magnetic layers.

The third magnetic powder sheet 104, according to this embodiment, may include a first indentation 128 on the lower surface 120 and a first extraction 130 on the upper surface 122 of the third magnetic powder sheet 104, wherein the first indentation 128 and the first extraction 130 extend substantially along the center of the third magnetic powder sheet 104 and from one edge to an opposing edge. The first indentation 128 and the first extraction 130 are oriented in a manner such that when the third magnetic powder sheet 104 is coupled to the second magnetic powder sheet 102, the first indentation 128 and the first extraction 130 extend in the same direction as the plurality of windings 108, 110, 112. The first indentation 128 is designed to encapsulate the plurality of windings 108, 110, 112.

The fourth magnetic powder sheet 106, according to this embodiment, may include a second indentation 132 on the lower surface 124 and a second extraction 134 on the upper surface 126 of the fourth magnetic powder sheet 106, wherein the second indentation 132 and the second extraction 134 extend substantially along the center of the fourth magnetic powder sheet 106 and from one edge to an opposing edge. The second indentation 132 and the second extraction 134 are oriented in a manner such that when the fourth magnetic powder sheet 106 is coupled to the third magnetic powder sheet 104, the second indentation 132 and the second extraction 134 extend in the same direction as the first indentation 128 and the first extraction 130. The second indentation 132 is designed to encapsulate the first extraction 130. Although this embodiment depicts an indentation and an extraction in the third and fourth magnetic powder sheets, the indentation or extraction formed in these sheets may be omitted without departing from the scope and spirit of the exemplary embodiment.

Upon forming the first magnetic powder sheet 100 and the second magnetic powder sheet 102, the first magnetic powder sheet 100 and the second magnetic powder sheet 102 are pressed together with high pressure, for example, hydraulic pressure, and laminated together to form a first portion 140 of the miniature power inductor 100. Also, the third magnetic powder sheet 104 and the fourth magnetic powder sheet 106 may also be pressed together to form a second portion of the miniature power inductor 100. According to this embodiment, the plurality of clips 108, 110, 112 are placed on the upper surface 118 of the first portion 140 of the miniature power inductor 100 such that the plurality of clips extend a distance beyond both sides of the first portion 140. This distance is equal to or greater than the height of the first portion 140 of the miniature power inductor 100. Once the plurality of clips 108, 110, 112 are properly positioned on the upper surface 118 of the first portion 140, the second portion is placed on top of the first portion 140. The first and second portions 140, of the miniature power inductor 100 may then be pressed together to form the completed miniature power inductor 100.

Portions of the plurality of clips 108, 110, 112, which extend beyond both edges of the miniature power inductor 100, may be bent around the first portion 140 to form a first termination 142, a second termination 144, a third termination 146, a fourth termination 148, a fifth termination 150, and a sixth termination 152. These terminations 150, 152, 142, 146, 144, 148 allow the miniature power inductor 100 to be properly coupled to a substrate or printed circuit board. According to this embodiment, the physical gap between the winding and the core, which is typically found in conventional inductors, is removed. The elimination of this physical gap tends to minimize the audible noise from the vibration of the winding.

The plurality of windings 108, 110, 112 is formed from a conductive copper layer, which may be deformed to provide a desired geometry. Although a conductive copper material is used in this embodiment, any conductive material may be used without departing from the scope and spirit of the exemplary embodiment.

Although only three clips are shown in this embodiment, greater or fewer clips may be used without departing from the scope and spirit of the exemplary embodiment. Although the clips are shown in a parallel configuration, the clips may be used in series depending upon the trace configuration of the substrate.

Although there are no magnetic sheets shown between the first and second magnetic powder sheets, magnetic sheets may positioned between the first and second magnetic powder sheets so long as the winding is of sufficient length to adequately form the terminals for the miniature power inductor without departing from the scope and spirit of the exemplary embodiment. Additionally, although two magnetic powder sheets are shown to be positioned above the plurality of windings 108, 110, 112, greater or fewer sheets may be used to increase or decrease the core area without departing from the scope and spirit of the exemplary embodiment.

In this embodiment, the magnetic field may be created in a direction that is perpendicular to the direction of grain orientation and thereby achieve a lower inductance or the magnetic field may be created in a direction that is parallel to the direction of grain orientation and thereby achieve a higher inductance depending upon which direction the magnetic powder sheet is extruded.

The moldable magnetic material defining the magnetic body 162 may be any of the materials mentioned above or other suitable materials known in the art. Exemplary magnetic powder particles to fabricate the magnetic layers 101, 102, 104, 106 and 108 may include Ferrite particles, Iron (Fe) particles, Sendust (Fe—Si—Al) particles, MPP (Ni—Mo—Fe) particles, HighFlux (Ni—Fe) particles, Megaflux (Fe—Si Alloy) particles, iron-based amorphous powder particles, cobalt-based amorphous powder particles, or other equivalent materials known in the art. When such magnetic powder particles are mixed with a polymeric binder material the resultant magnetic material exhibits distributed gap properties that avoids any need to physically gap or separate different pieces of magnetic materials. As such, difficulties and expenses associated with establishing and maintaining consistent physical gap sizes are advantageously avoided. For high current applications, a pre-annealed magnetic amorphous metal powder combined with a polymer binder may be advantageous.

Figure 6:
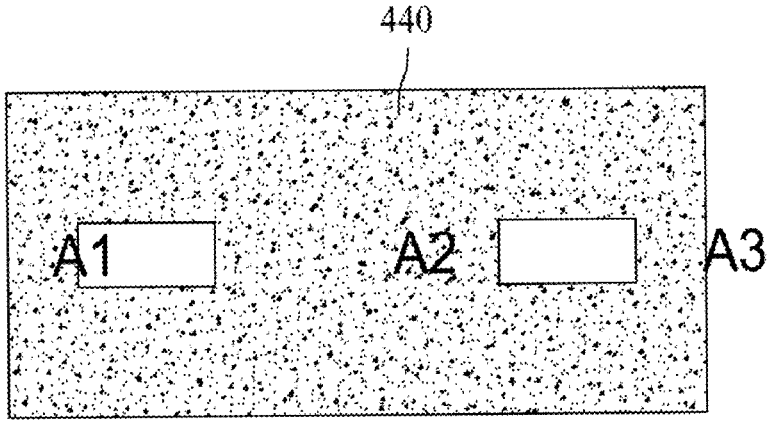
FIG. 6 illustrates a cross sectional view of a magnetic component including an arrangement of coils shown in FIG. 5.

While magnetic powder materials mixed with binder are believed to be advantageous, neither powder particles nor a non-magnetic binder material are necessarily required for the magnetic material forming the magnetic body 162. Additionally, the moldable magnetic material need not be provided in sheets or layers as described above, but rather may be directly coupled to the coils 164 using compression molding techniques or other techniques known in the art. While the body 162 shown in FIG. 6 is generally elongated and rectangular, other shapes of the magnetic body 162 are possible.

In various examples, the magnetic component 100 may be specifically adapted for use as a transformers or inductors in direct current (DC) power applications, single phase voltage converter power applications, two phase voltage converter power applications, three phase voltage converter power applications, and multi-phase power applications. In various embodiments, the coils 108, 110, 112 may be electrically connected in series or in parallel, either in the components themselves or via circuitry in the boards on which they are mounted, to accomplish different objectives.

When two or more independent coils are provided in one magnetic component, the coils may be arranged so that there is flux sharing between the coils. That is, the coils utilize common flux paths through portions of a single magnetic body.

Figure 5:
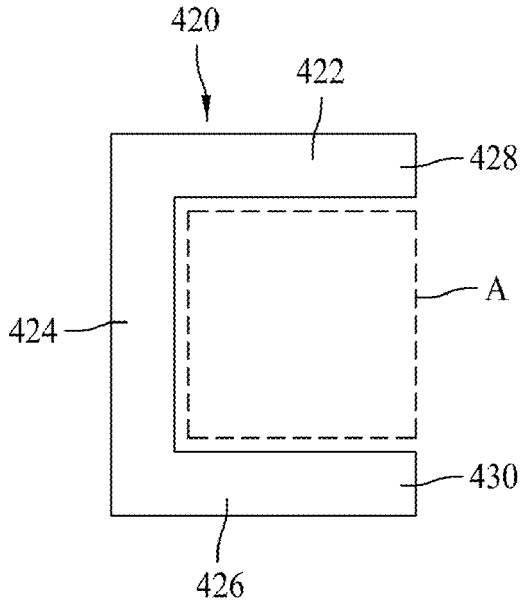
FIG. 5 illustrates a coil configuration according to an embodiment of the present invention.

FIG. 5 illustrates an exemplary coil 420 that may be fabricated as a generally planar element from stamped metal, printing techniques, or other fabrication techniques known in the art. The coil 420 is generally C-shaped as shown in FIG. 5, and includes a first generally straight conductive path 422, a second generally straight conductive path 424 extending at a right angle from the first conductive path 422, and a third conductive path 426 extending generally at a right angle from the second conductive path 424 and in a generally parallel orientation to the first conductive path 422. Coil ends 428, 430 are defined at the distal ends of the first and third conductive paths 422, 426, and a ¾ turn is provided through the coil 420 in the conductive paths 422, 424 and 426. An inner periphery of the coil 420 defines a central flux area A (shown in phantom in FIG. 5). The area A defines an interior region in which flux paths may be passed as flux is generated in the coil 422. Alternatively stated, the area A includes flux paths extending at a location between the conductive path 422 and the conductive path 426, and the location between the conductive path 424 and an imaginary line connecting the coil ends 428, 430. When a plurality of such coils 420 are utilized in a magnetic body, the central flux areas may be partially overlapped with one another to mutually couple the coils to one another. While a specific coil shape is shown in FIG. 5, it is recognized that other coil shapes may be utilized with similar effect in other embodiments.

FIG. 6 represents a cross section of several coils 420 in a magnetic body 440. In the embodiment shown, the body is fabricated from magnetic metal powder particles surrounded by a non-magnetic material, wherein adjacent metal powder particles are separated from one another by the non-magnetic material. Other magnetic materials may alternatively be used in other embodiments. The magnetic materials may have distributed gap properties that avoid a need for discrete core pieces that must be physically gapped in relation to one other.

Coils, such as the coils 420, are arranged in the magnetic body 440. As shown in FIG. 6, the area A1 designates a central flux area of the first coil, the area A2 designates a central flux area of a second coil, and the area A3 designates a central flux area of the third coil. Depending on the arrangement of the coils in the magnetic body 440 (i.e. the spacing of the coils), the areas A1, A2 and A3 may be overlapped, but not completely overlapped such that the mutual coupling of the coils may be varied throughout different portions of the magnetic body 440. In particular, the coils may be offset or staggered relative to one another in the magnetic body such that some but not all of the area A defined by each coil overlaps another coil. In addition the coils may be arranged in the magnetic body such that a portion of the area A in each coil does not overlap with any other coil.

In the non-overlapping portions of the areas A of adjacent coils in the magnetic body 440, a portion of the flux generated by each respective coil returns only in the central flux area of the respective coil that generates it, without passing through the central flux area A of an adjacent coil.

In the overlapping portions of the areas A of adjacent coils in the magnetic body 440, a portion of the flux generated by each respective coil returns in the central flux area A of the respective coil that generates it, and also passes through the overlapping central flux areas A of adjacent coils.

By varying the degree of overlapping and non-overlapping portions of the coil central flux areas A, the degree of coupling between the coils can be changed. Also, by varying a separation distance in a direction normal to the plane of the coils (i.e. by locating the coils in spaced apart planes) a magnetic reluctance of the flux paths may be varied throughout the magnetic body 440. The product of an overlapping central flux area of adjacent coils and the special distance between them determines a cross sectional area in the magnetic body through with the common flux paths may pass through the magnetic body 440. By varying this cross sectional area, magnetic reluctance may be varied with related performance advantages.

FIGS. 27-33 include simulation and test results, and comparative data for conventional magnetic components having discrete core pieces that are physically gapped versus the distributed gap core embodiments of the present invention. The information shown in FIGS. 27-33 also relates to coupling characteristics of exemplary embodiments of components using the methodology described in relation to FIG. 6.

Figure 7:
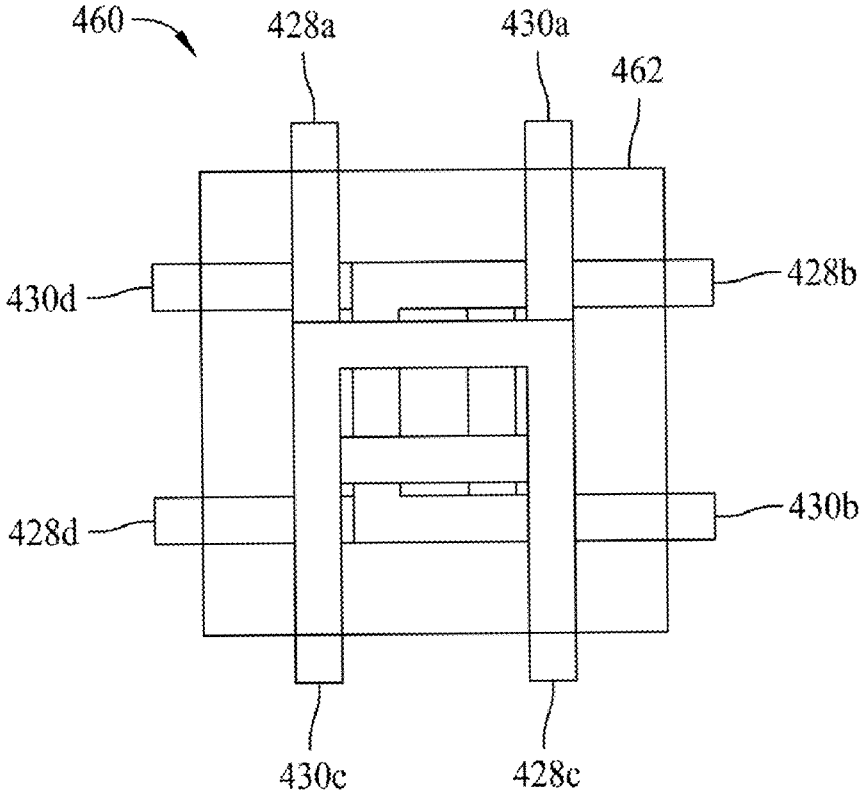
FIG. 7 is a top schematic view of a magnetic component including coupled coils in accordance with an exemplary embodiment of the invention.

FIG. 7 schematically illustrates a magnetic component assembly 460 having a number of coils arranged with partly overlapping and non-overlapping flux areas A within a magnetic body 462 such as that described above. Four coils are shown in the assembly 460, although greater or fewer numbers of coils may be utilized in other embodiments. Each of the coils is similar to the coil 420 shown in FIG. 5, although other shapes of coils could be used in alternative embodiments.

The first coil is designated by the coil ends 428*a*, 430 *a* extending from a first face of the magnetic body 462. The first coil may extend in a first plane in the magnetic body 462.

The second coil is designated by the coil ends 428*b*, 430*b* extending from a second face of the magnetic body 462. The second coil may extend in a second plane in the magnetic body 462 spaced from the first plane.

The third coil is designated by the coil ends 428*c*, 430*c* extending from a third face of the magnetic body 462. The third coil may extend in a third plane in the magnetic body 462 that is spaced from the first and second planes.

The fourth coil is designated by the coil ends 428*d*, 430*d* extending from a fourth face of the magnetic body 462. The fourth coil may extend in a fourth plane in the magnetic body 462 that is spaced from the first, second and third planes.

The first, second, third and fourth faces or sides define a generally orthogonal magnetic body 462 as shown. Corresponding central flux areas A for the first, second, third, and fourth coils are found to overlap one another in various ways. Portions of the central flux areas A for each of the four coils overlaps none of the other coils. Other portions of the flux areas A of each respective coils overlaps one of the other coils. Still other portions of the flux areas of each respective coil overlaps two of the other coils. In yet another portion, the flux areas of each respective coil located closest to the center of the magnetic body 462 in FIG. 7, overlaps each of the other three coils. A good deal of variation in coil coupling is therefore established through different portions of the magnetic body 462. Also, by varying the spatial separation of the planes of the first, second, third and fourth coils, a good deal of variation of magnetic reluctance in the flux paths can also be provided.

In particular, the spacing between the planes of the coils need not be the same, such that some coils can be located closer together (or farther apart) relative to other coils in the assembly. Again, the central flux area of each coil and the spacing from adjacent coils in a direction normal to the plane of the coils defines a cross sectional area through which the generated flux passes in the magnetic body. By varying the spatial separation of the coil planes, the cross-sectional area associated with each coil may vary among at least two of the coils.

Like other embodiments described, the various coils in the assembly may be connected to different phases of electrical power in some applications.

Figure 8:
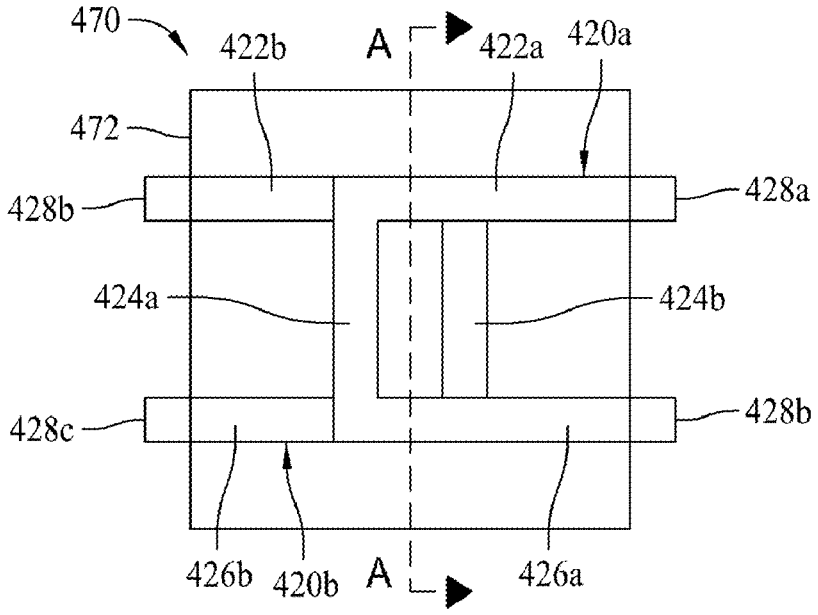
FIG. 8 is a top schematic view of another magnetic component assembly including coupled coils.

FIG. 8 illustrates another embodiment of a magnetic component assembly 470 having two coils 420 *a* and 420*b* that are partly overlapping and partly non-overlapping in their flux areas A. As shown in cross section in FIG. 9, the two coils are located in different planes in the magnetic body 472.

Figure 10:
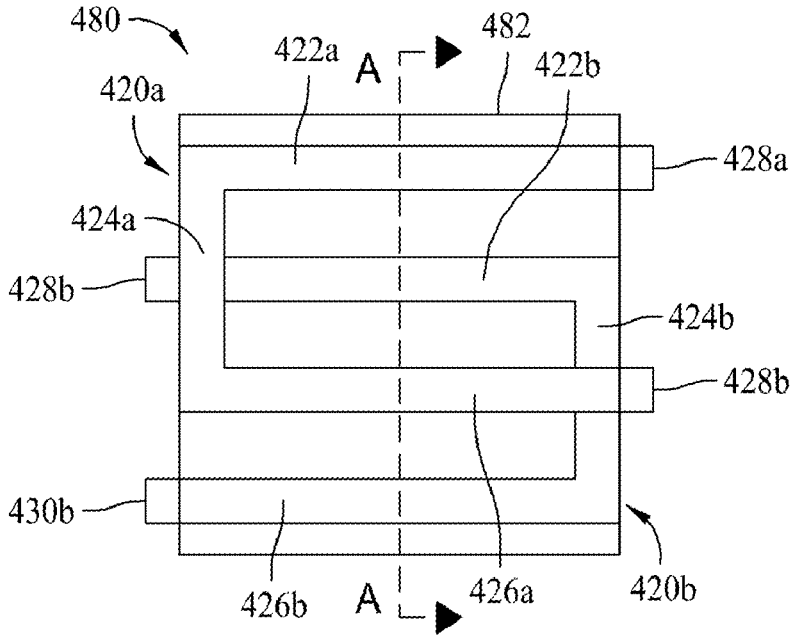
FIG. 10 is a top schematic view of another magnetic component assembly including coupled coils.
Figure 11:
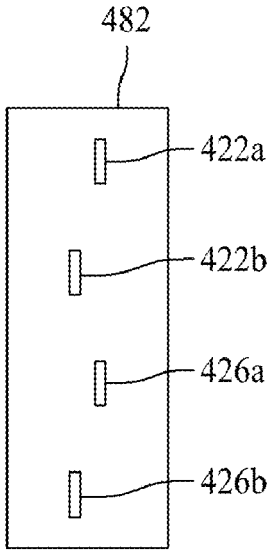
FIG. 11 is a cross sectional view of the component shown in FIG. 10.
Figure 12:
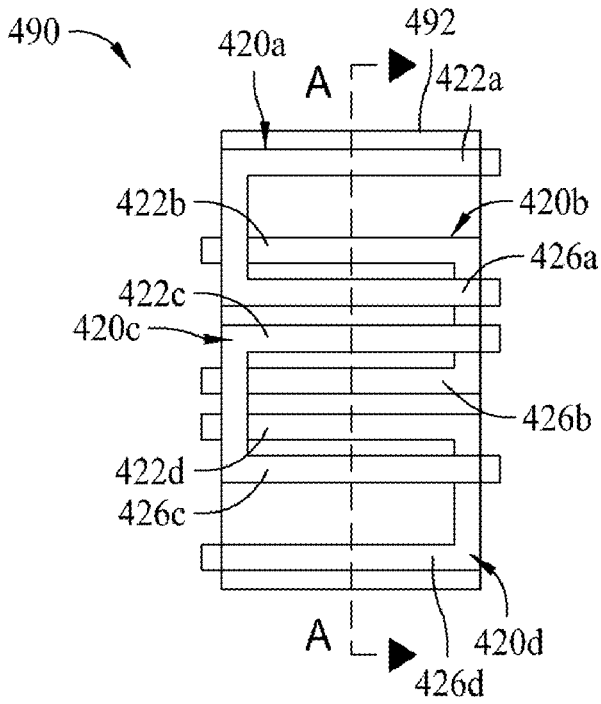
FIG. 12 is a top schematic view of another embodiment of a magnetic component including coupled coils in accordance with an exemplary embodiment of the invention.

FIG. 10 illustrates another embodiment of a magnetic component assembly 480 having two coils 420 *a* and 420*b* that are partly overlapping and partly non-overlapping in their flux areas A. As shown in cross section in FIG. 11, the two coils are located in different planes in the magnetic body 482.

Figure 13:
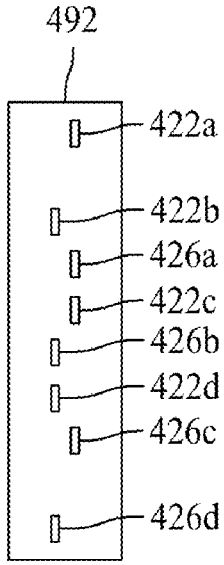
FIG. 13 is a cross sectional view of the component shown in FIG. 12.
Figure 14:
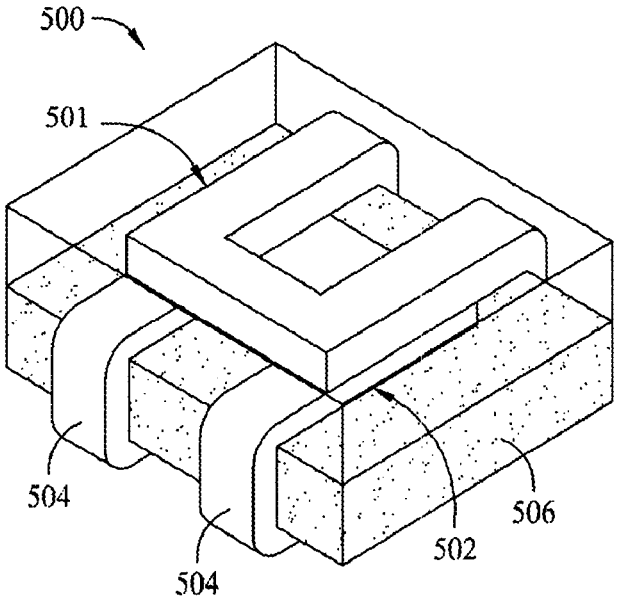
FIG. 14 is a perspective view of another embodiment of a magnetic component including coupled coils in accordance with an exemplary embodiment of the invention.
Figure 15:
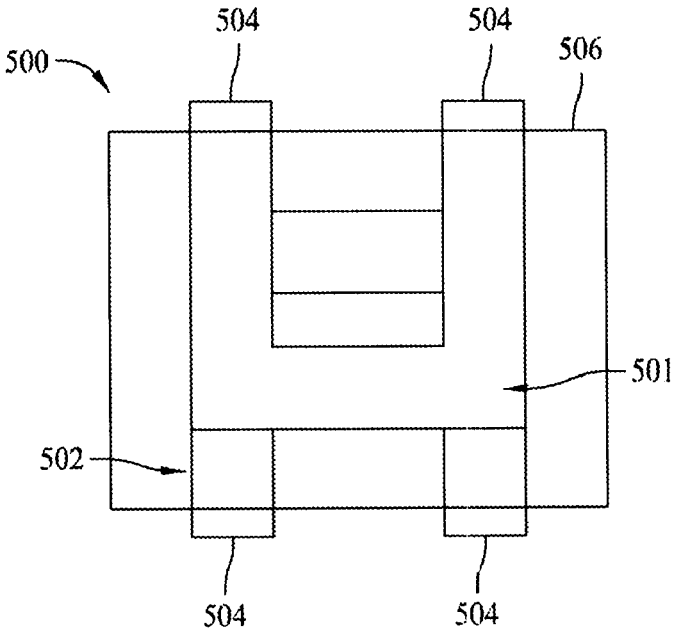
FIG. 15 is a top schematic view of the component shown in FIG. 14.
Figure 16:
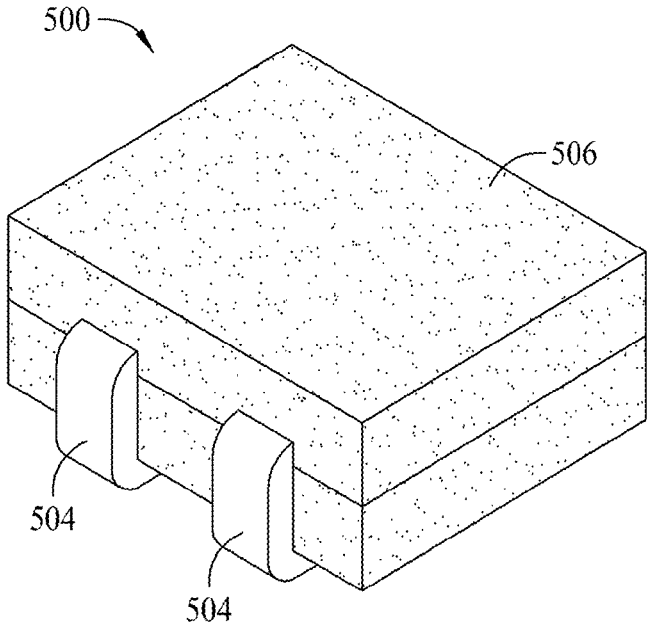
FIG. 16 is a top perspective view of the component shown in FIG. 14.

FIG. 13 illustrates another embodiment of a magnetic component assembly 490 having four coils 420 *a*, 420*b*, 420*c* and 420*d* that are partly overlapping and partly non-overlapping in their flux areas A. As shown in cross section in FIG. 11, the four coils are located in different planes in the magnetic body 492.

Figure 9:
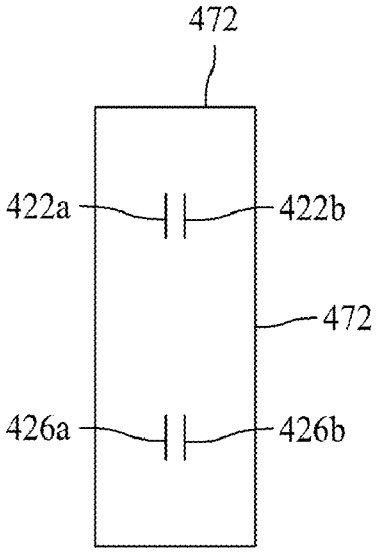
FIG. 9 is a cross sectional view of the component assembly shown in FIG. 8.

FIGS. 14-17 show an embodiment of a magnetic component assembly 500 having a coil arrangement similar to that shown in FIGS. 8 and 9. The coils 501 and 502 include wrap around terminal ends 504 extending around the sides of the magnetic body 506. The magnetic body 506 may be formed as described above or as known in the art, and may have a layered or non-layered construction. The assembly 500 may be surface mounted to a circuit board via the terminal ends 504.

Figure 34:
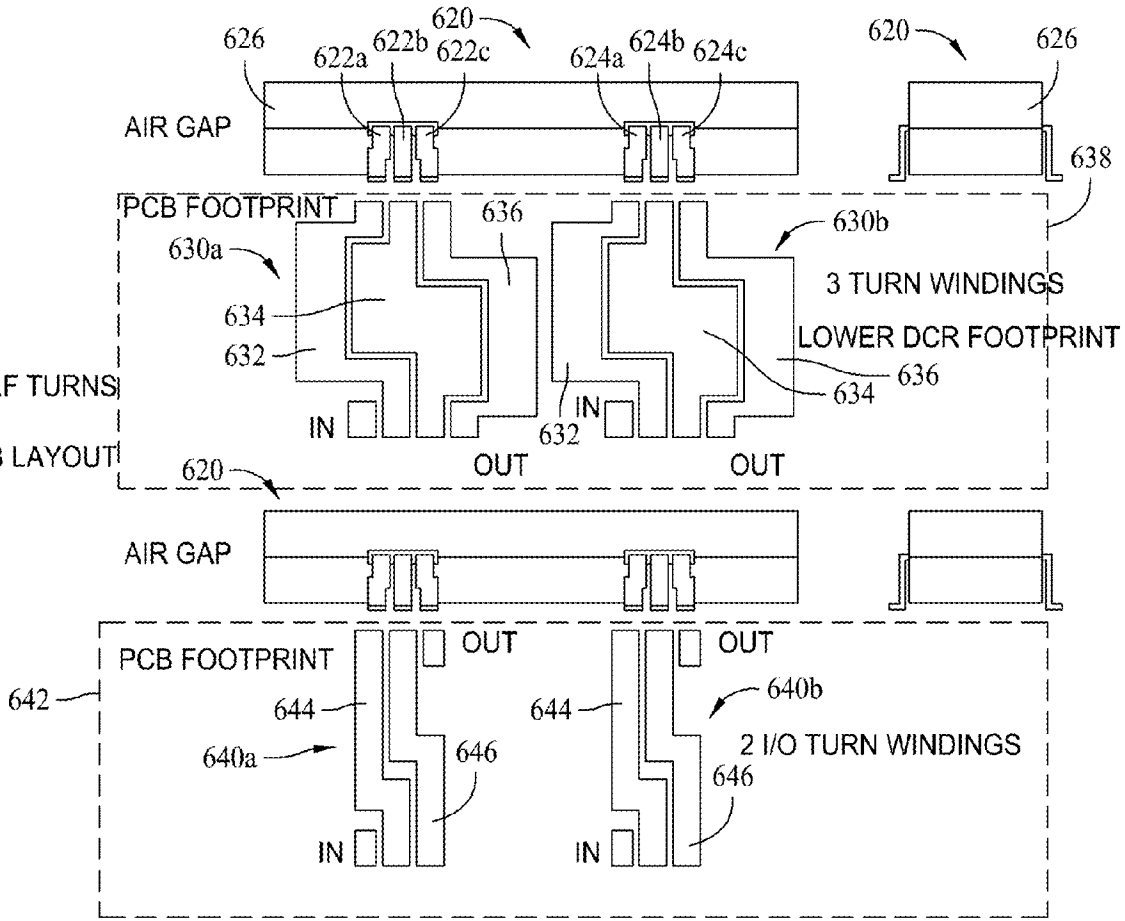
FIG. 34 illustrates embodiments of a magnetic component assembly and circuit board layouts therefore.

FIG. 34 illustrates another embodiment of a magnetic component assembly 620 having coupled inductors and illustrating their relation to circuit board layouts. The magnetic component 620 may be constructed and operate similarly to those described above, but may be utilized with different circuit board layouts to achieve different effects.

In the embodiment shown, the magnetic component assembly 620 is adapted for voltage converter power applications and accordingly includes a first set of conductive windings 622*a*, 622*b*, 622*c* and a second set of conductive windings 624*a*, 624*b*, 624*c* within a magnetic body 626. Each of the windings 622*a*, 622*b*, 622*c*, and the windings 624*a*, 624*b*, 624*c* may complete a ½ turn, for example in the inductor body, although the turns completed in the windings may alternatively be more or less in other embodiments. The coils may physically couple to each other through their physical positioning within the magnetic body 626, as well as through their shape Exemplary circuit board layouts or "footprints" 630 *a* and 630*b* are shown in FIG. 34 for use with the magnetic component assembly 620. As shown in FIG. 34, each of the layouts 630 *a* and 630*b* include three conductive paths 632, 634, and 636 that each define a ½ turn winding. The layouts 630 *a* and 630*b* are provided on a circuit board 638 (shown in phantom in FIG. 34) using known techniques.

When the magnetic component assembly 620 is surface mounted to the layouts 630 *a*, 630*b* to electrically connect the component coils 622 and 624 to the layouts 630 *a*, 630*b*, it can be seen that the total coil winding path established is three turns for each phase. Each half turn coil winding in the component 620 connects to a half turn winding in the board layouts 630 *a*, 630*b* and the windings are connected in series, resulting in three total turns for each phase.

As FIG. 34 illustrates, the same magnetic component assembly 620 may alternatively be connected to a different circuit board layout 640 *a*, 640*b* on another circuit board 642 (shown in phantom in FIG. 34) to accomplish a different effect. In the example shown, the layouts 640 *a*, 640*b* include two conductive paths 644, 646 that each define a ½ turn winding.

When the magnetic component assembly 620 is surface mounted to the layouts 640 *a*, 640*b* to electrically connect the component coils 622 and 624 to the layouts 640 *a*, 640*b*, it can be seen that the total coil winding path established is 2½ turns for each phase.

Because the effect of the component 620 can be changed by varying the circuit board layouts to which it is connected, the component is sometimes referred to as a programmable coupled inductor. That is, the degree of coupling of the coils can be varied depending on the circuit board layout. As such, while substantially identical component assemblies 620 may be provided, their operation may be different depending on where they are connected to the circuit board(s) if different layouts are provided for the components. Varying circuit board layouts may be provided on different areas of the same circuit board or different circuit boards.

Many other variations are possible. For example, a magnetic component assembly may include five coils each having ½ turns embedded in a magnetic body, and the component can be used with up to eleven different and increasing inductance values selected by a user via the manner in which the user lays out the conductive traces on the boards to complete the winding turns.

Figure 35:
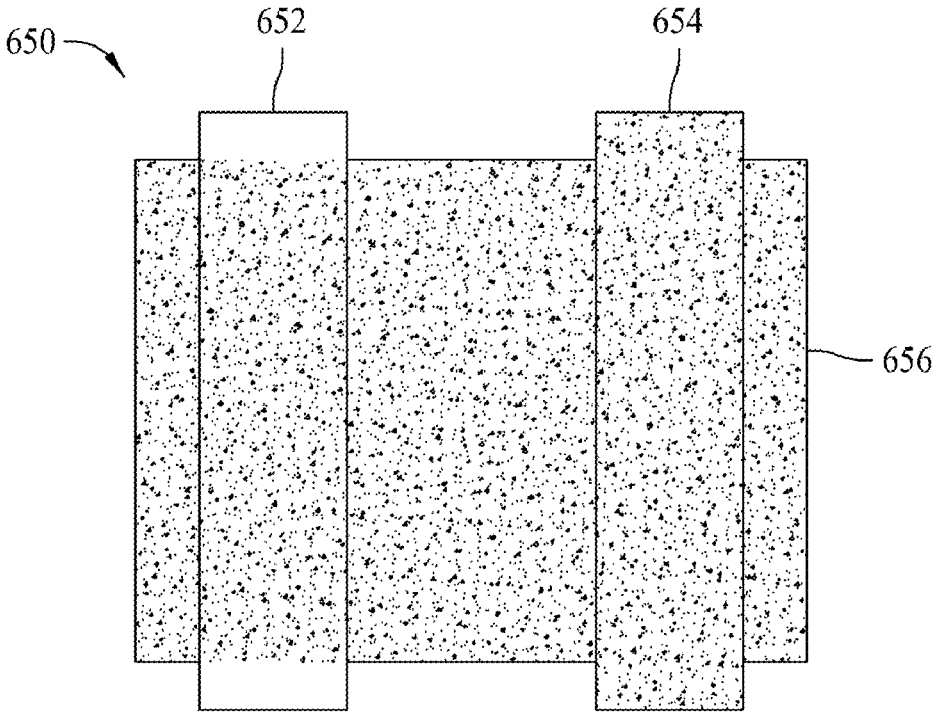
FIG. 35 illustrates another magnetic component assembly having coupled coils.
Figure 36:
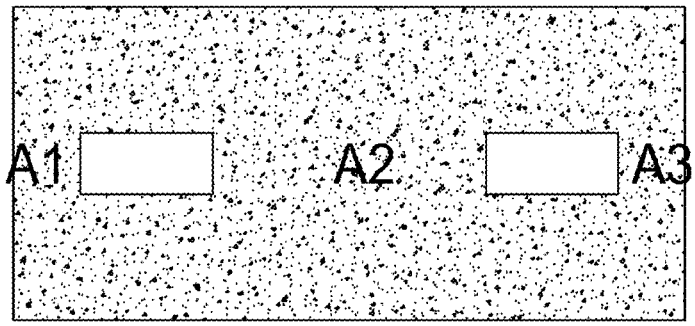
FIG. 36 is a cross sectional view of the assembly shown in FIG. 35.

FIGS. 35 and 36 illustrate another magnetic component assembly 650 having coupled coils 652, 654 within a magnetic body 656. The coils 652, 654 couple in a symmetric fashion in the area A2 of the body 656, while being uncoupled in the area Al and A3 in FIG. 36. The degree of coupling in the area A2 can be varied depending on the separation of the coils 652 and 654.

Figure 37:
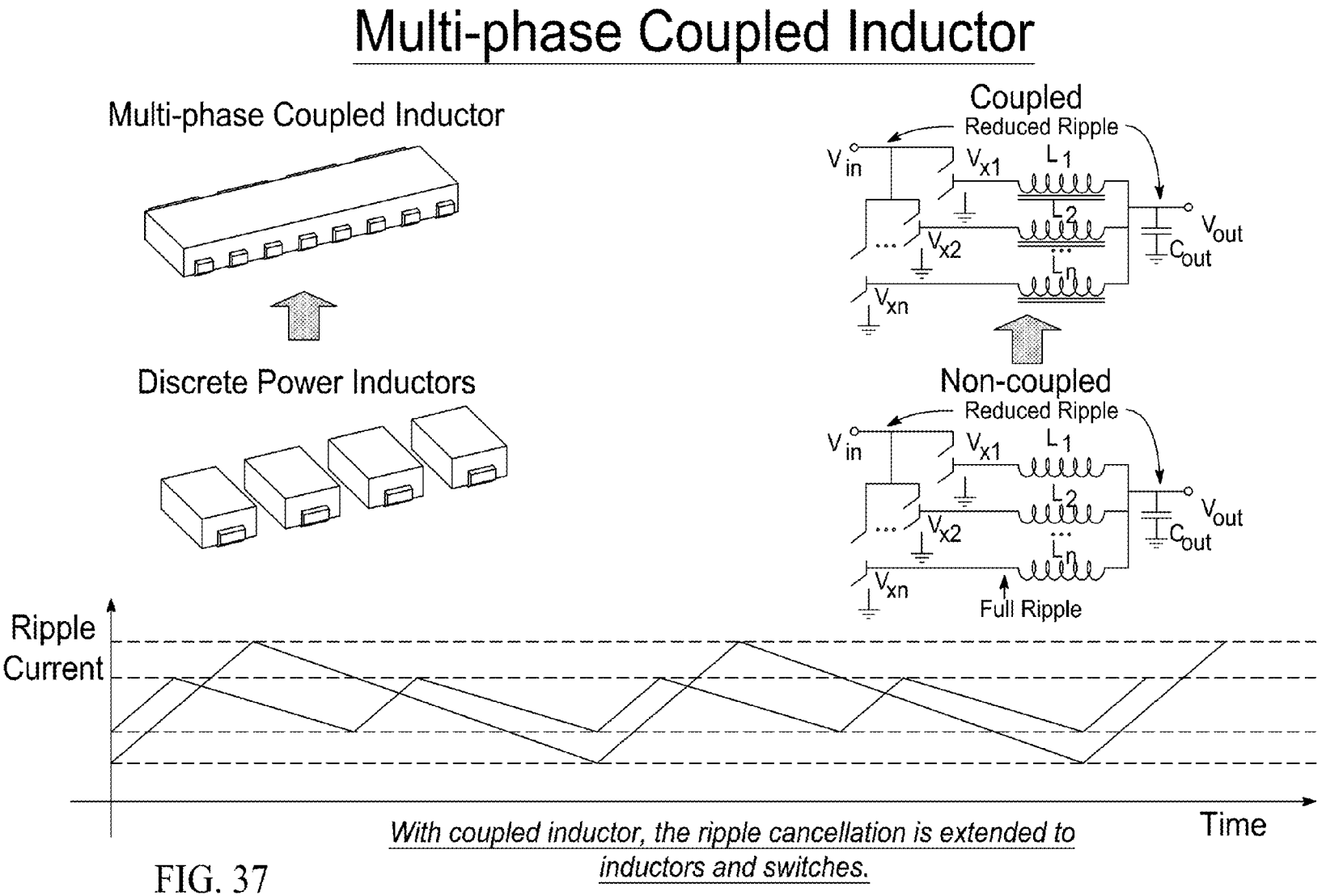
FIG. 37 illustrates a comparison of ripple current of an embodiment of the present invention having coupled coils versus discrete magnetic components without coupled coils.

FIG. 37 illustrates an advantage of a multiphase magnetic component having coupled coils in the manner described versus a number of discrete, non-coupled magnetic components being used for each phase as has conventionally been done. Specifically, ripple currents are at least partially cancelled when using the multiphase magnetic components having coupled coils such as those described herein.

Figure 17:
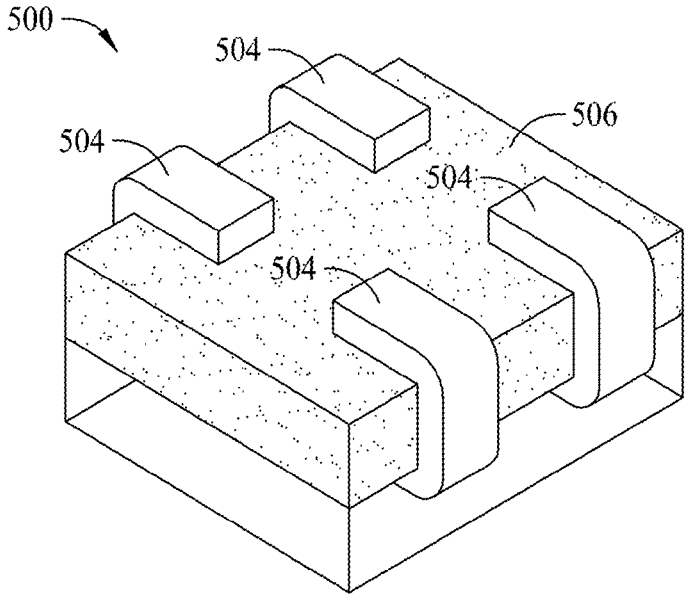
FIG. 17 is a bottom perspective view of the component shown in FIG. 14.
Figure 18:
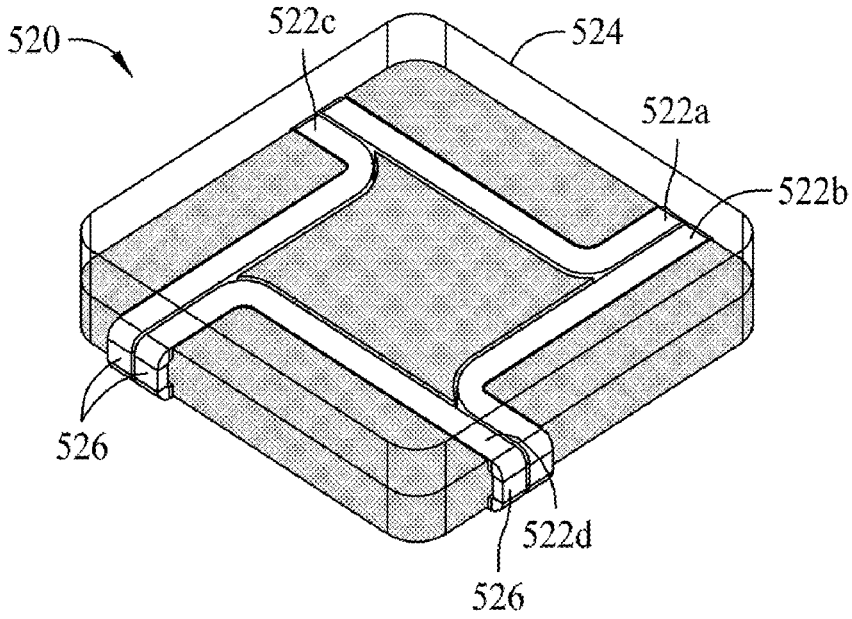
FIG. 18 is a perspective view of another embodiment of a magnetic component including coupled coils in accordance with an exemplary embodiment of the invention.
Figure 19:
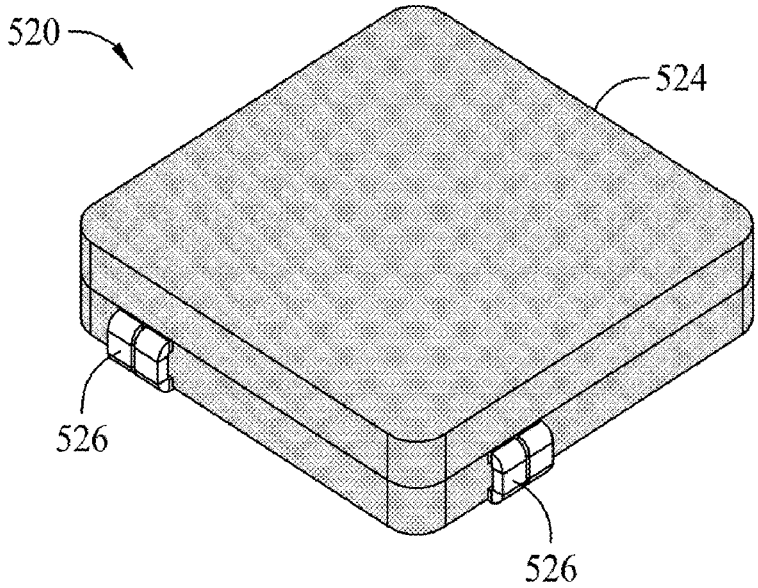
FIG. 19 is a top schematic view of the component shown in FIG. 18.
Figure 20:
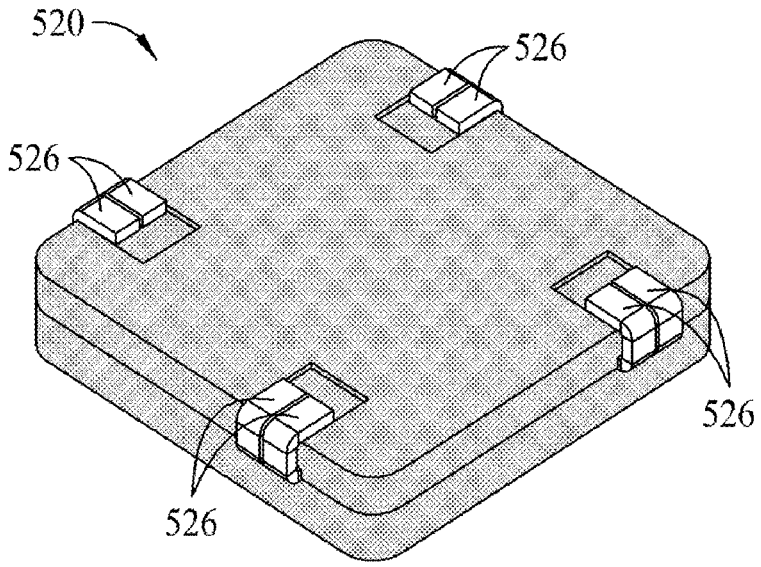
FIG. 20 is a bottom perspective view of the component shown in FIG. 18.

FIGS. 18-20 illustrate another magnetic component assembly 520 having a number of partial turn coils 522*a*, 522*b*, 522*c* and 522*d* within a magnetic body 524. As shown in FIG. 17, each coil 522*a*, 522*b*, 522*c* and 522*d* provides a one half turn. While four coils 522*a*, 522*b*, 522*c* and 522*d* are shown, greater or fewer numbers of coils could alternatively be provided.

Each coil 522*a*, 522*b*, 522*c* and 522*d* may be connected to another half turn coil, for example, that may be provided on a circuit board. Each coil 522*a*, 522*b*, 522*c* and 522*d* is provided with wrap around terminal ends 526 that may be surface mounted to the circuit board.

Figure 21:
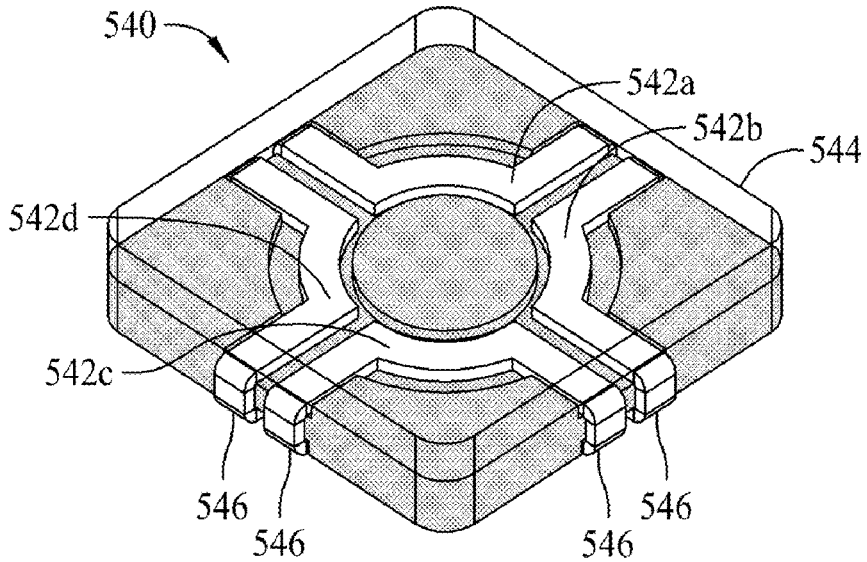
FIG. 21 is a perspective view of another embodiment of a magnetic component including coupled coils in accordance with an exemplary embodiment of the invention.
Figure 22:
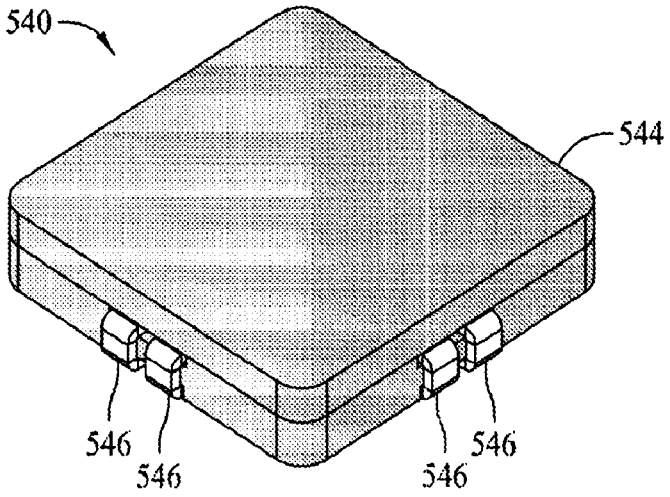
FIG. 22 is a top schematic view of the component shown in FIG. 21.
Figure 23:
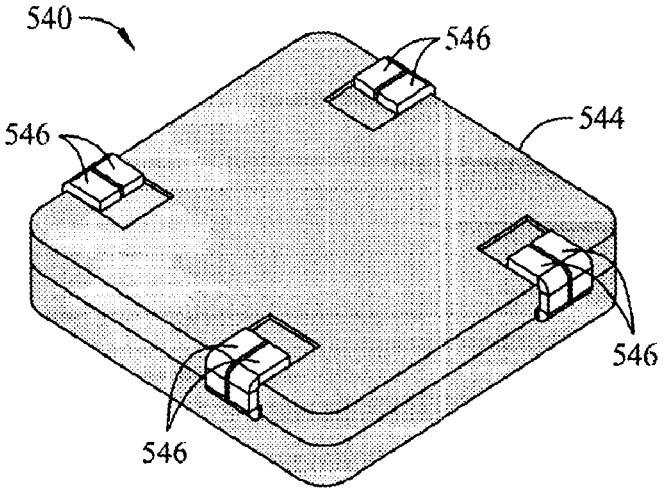
FIG. 23 is a bottom perspective view of the component shown in FIG. 21.

FIGS. 21-23 illustrate another magnetic component assembly 540 having a number of partial turn coils 542*a*, 542*b*, 542*c* and 542*d* within a magnetic body 544. The coils 542*a*, 542*b*, 542*c* and 542*d* are seen to have a different shape than the coils shown in FIG. 18. While four coils 542*a*, 542*b*, 542*c* and 542*d* are shown, greater or fewer numbers of coils could alternatively be provided.

Each coil 542*a*, 542*b*, 542*c* and 542*d* may be connected to another partial turn coil, for example, that may be provided on a circuit board. Each coil 542*a*, 542*b*, 542*c* and 542*d* is provided with wrap around terminal ends 546 that may be surface mounted to the circuit board.

Figure 24:
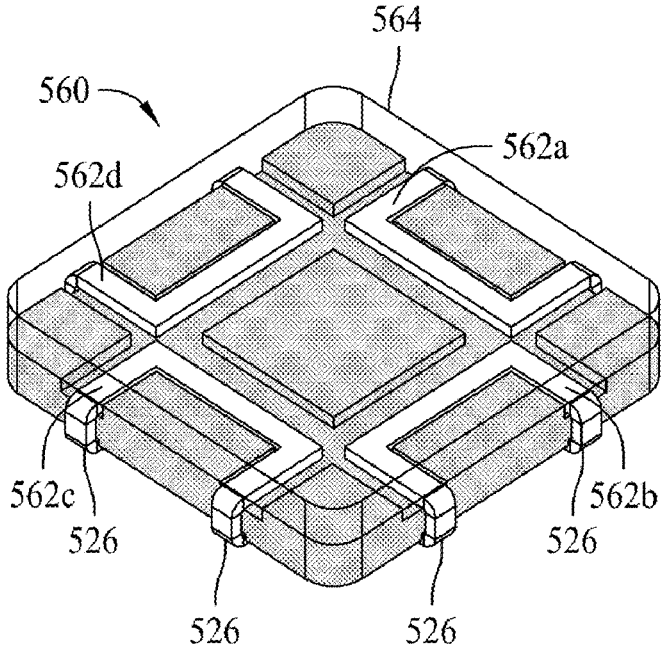
FIG. 24 is a perspective view of another embodiment of a magnetic component including coupled coils in accordance with an exemplary embodiment of the invention.
Figure 25:
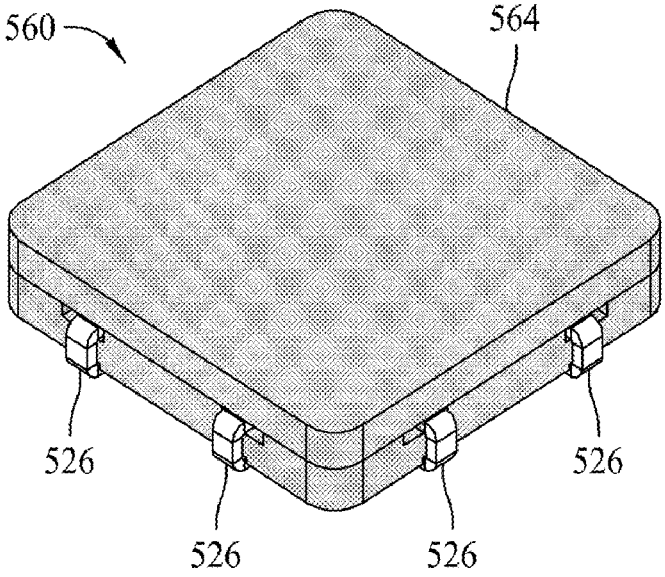
FIG. 25 is a top schematic view of the component shown in FIG. 24.
Figure 26:
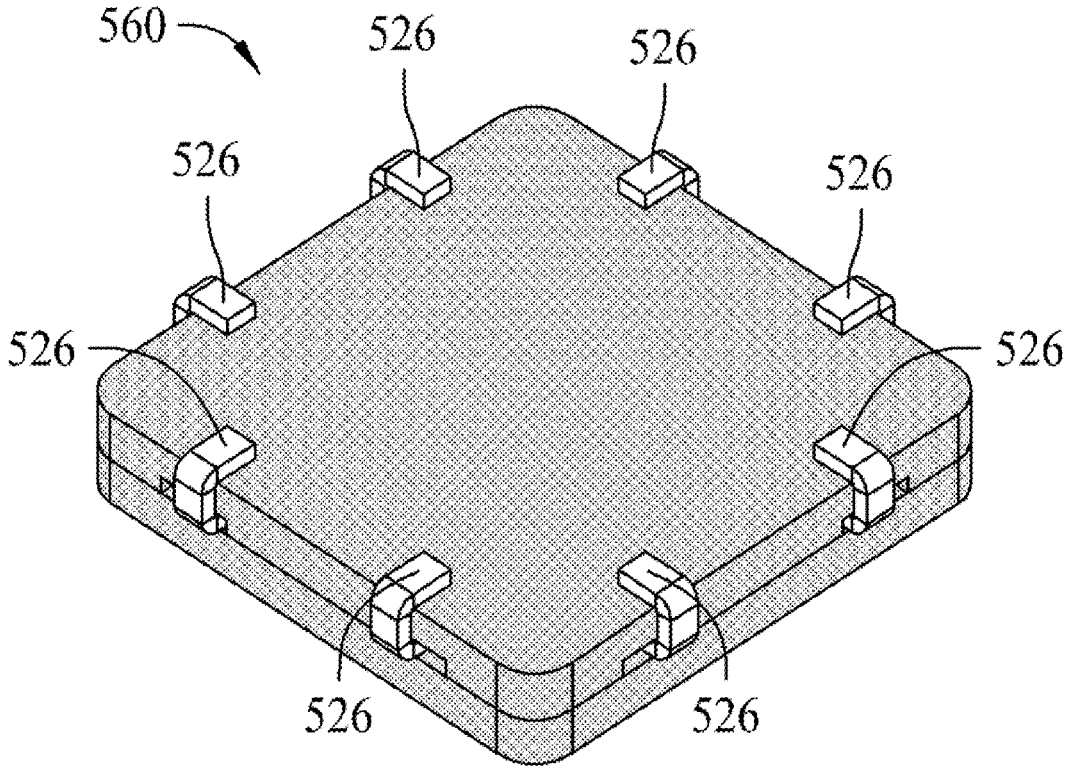
FIG. 26 is a bottom perspective view of the component shown in FIG. 24.
Figure 27:
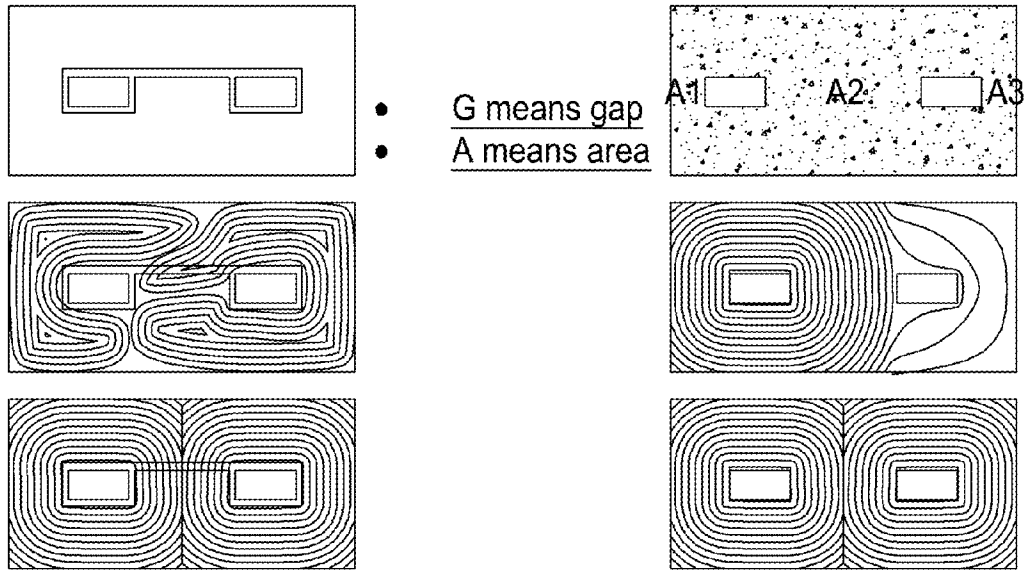
FIG. 27 illustrates simulation and test results of magnetic components including coupled coils in accordance with an exemplary embodiment of the invention versus components having discrete core pieces that are physically gapped.
Figure 28:
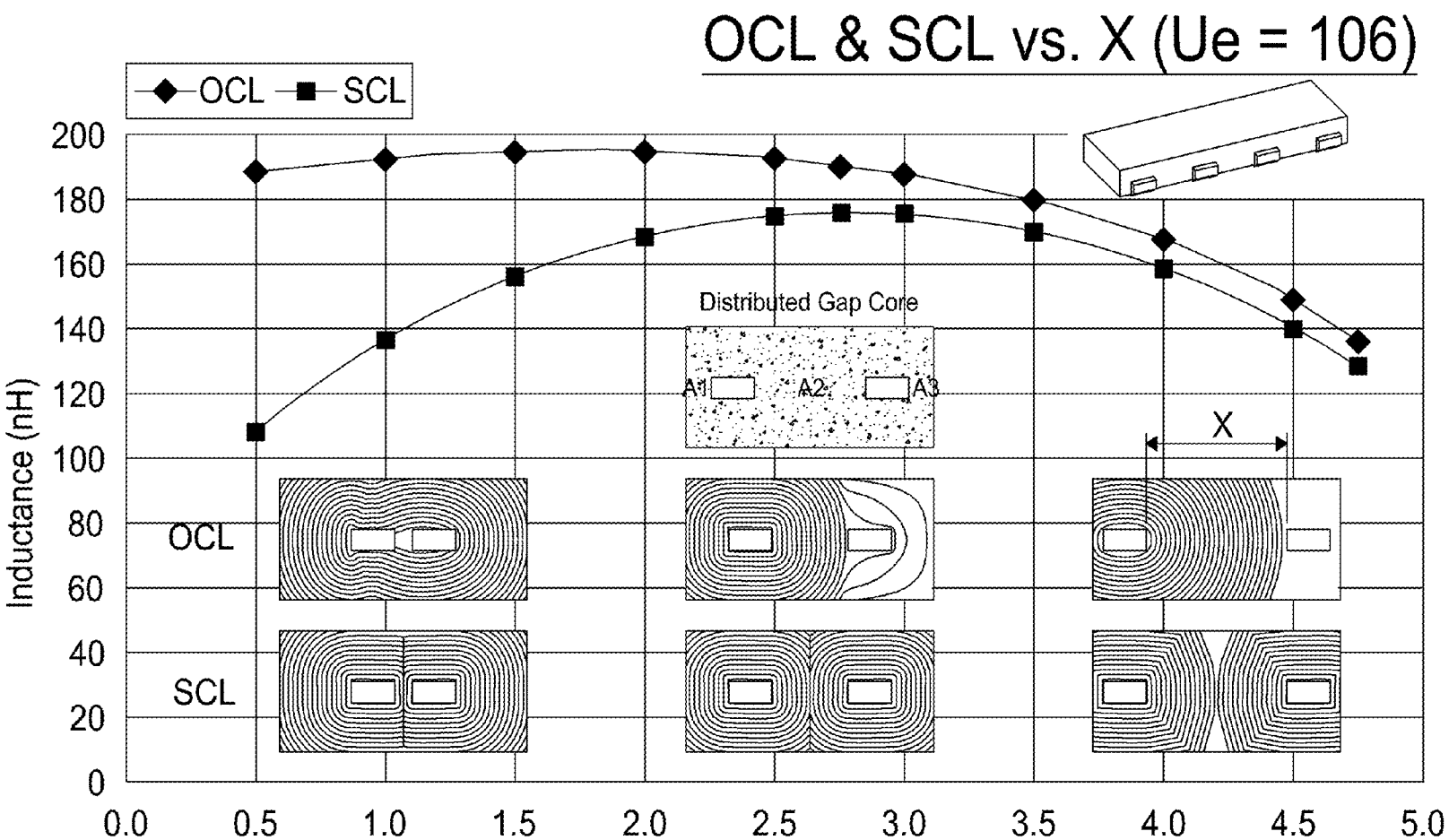
FIG. 28 illustrates further analysis of magnetic components including coupled coils in accordance with an exemplary embodiment of the invention.
Figure 29:
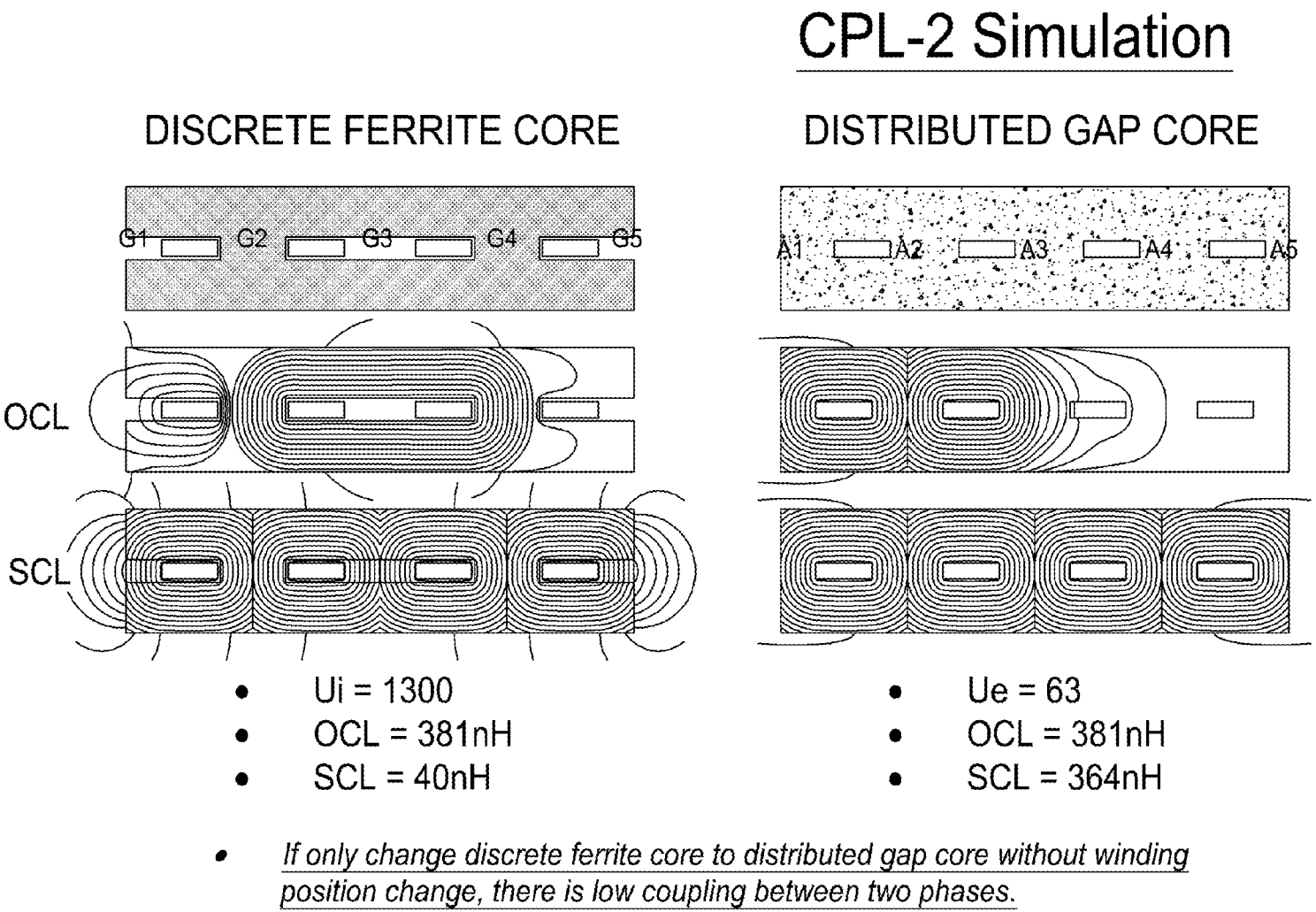
FIG. 29 illustrates simulation data of magnetic components including coupled coils in accordance with an exemplary embodiment of the invention versus components having discrete core pieces that are physically gapped.
Figure 30:
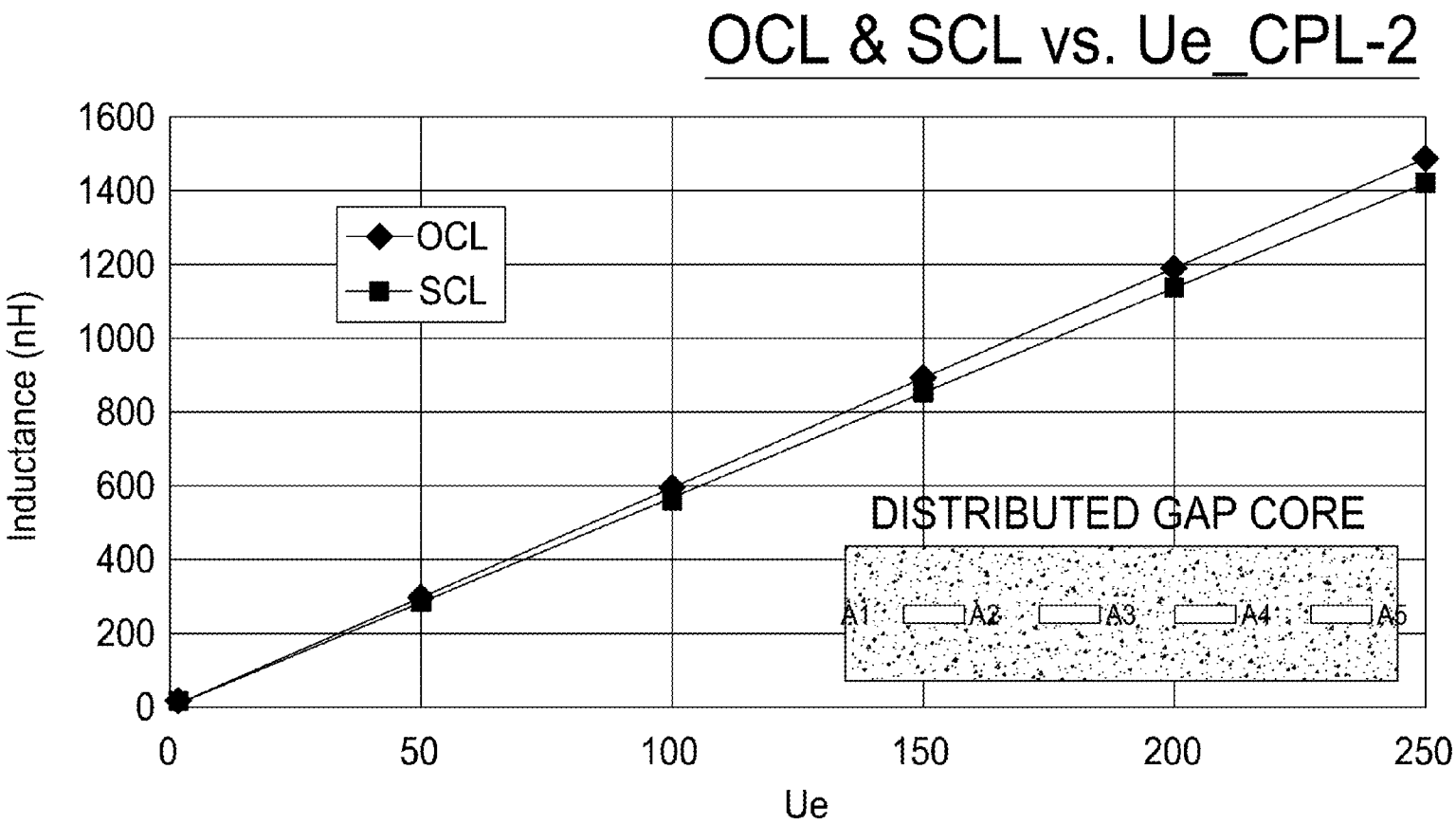
FIG. 30 illustrates further analysis of magnetic components including coupled coils in accordance with an exemplary embodiment of the invention.
Figure 31:
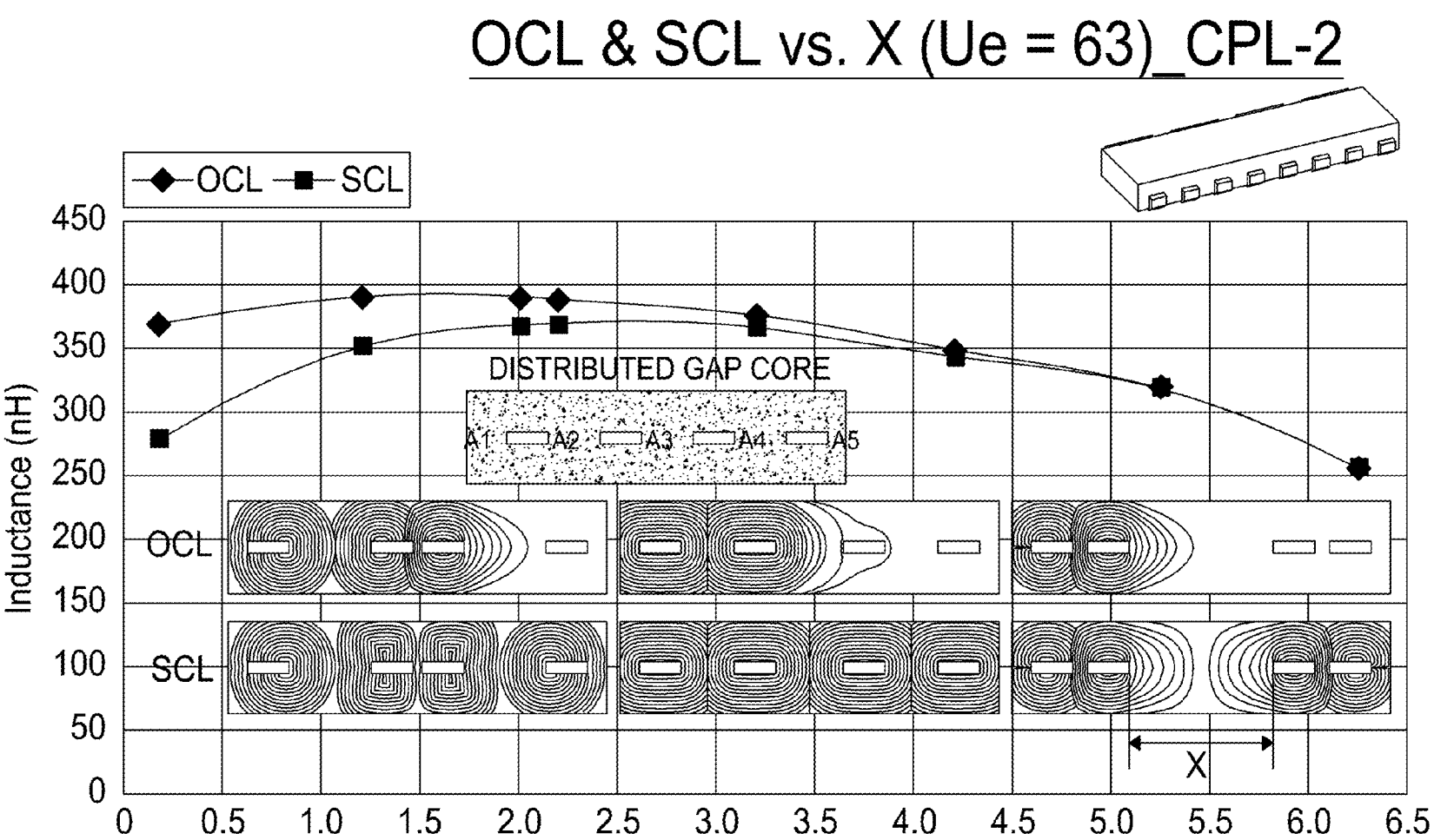
FIG. 31 illustrates further analysis of magnetic components including coupled coils in accordance with an exemplary embodiment of the invention.
Figure 32:
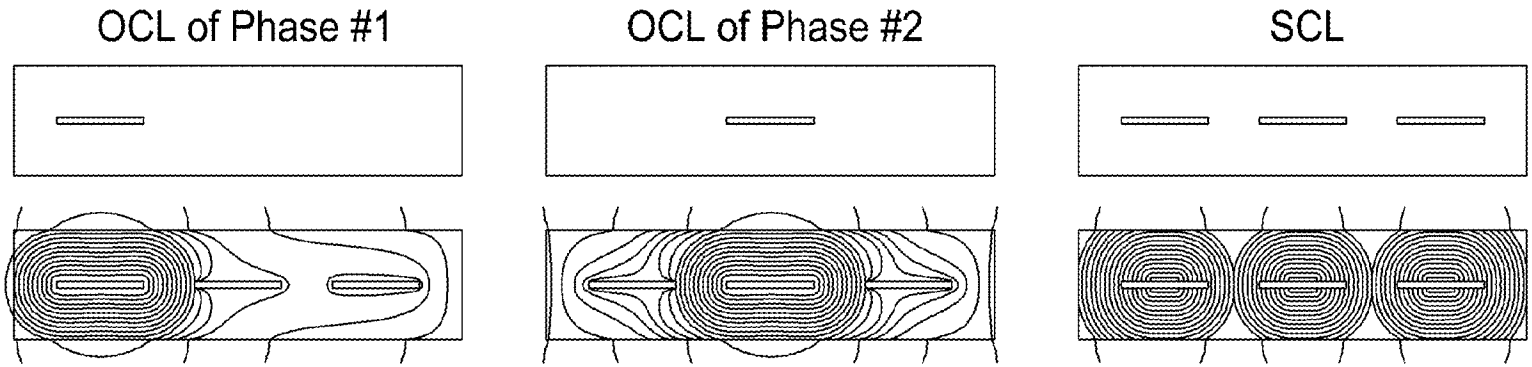
FIG. 32 illustrates simulation and test results of magnetic components including coupled coils in accordance with an exemplary embodiment of the invention.
Figure 32:
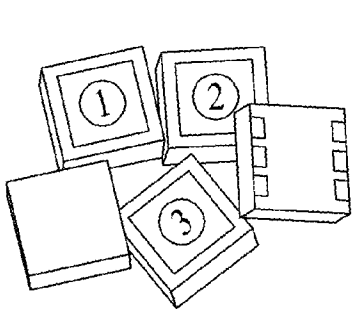
Figure 33:
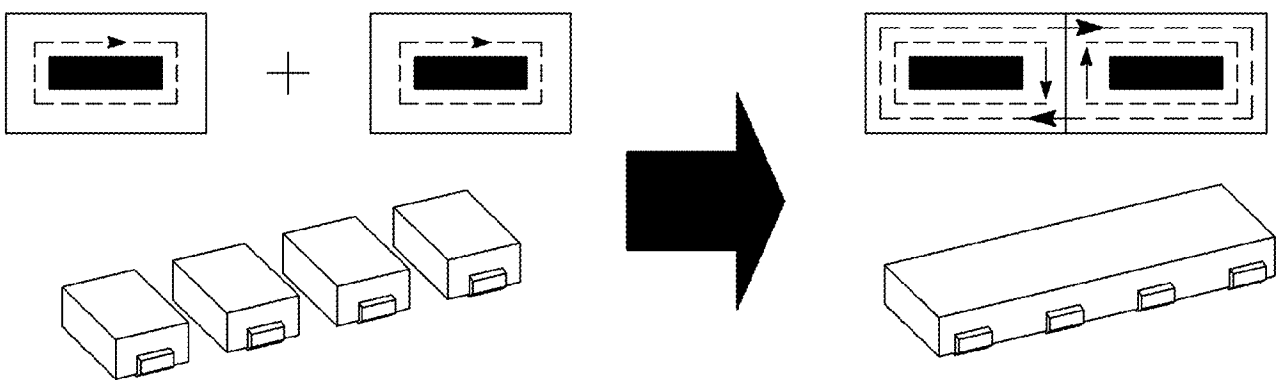
FIG. 33 illustrates coupling conclusions derived from the information of FIGS. 27-31.

FIGS. 24-26 illustrate another magnetic component assembly 560 having a number of partial turn coils 562*a*, 562*b*, 562*c* and 562*d* within a magnetic body 564. The coils 562*a*, 562*b*, 562*c* and 562*d* are seen to have a different shape than the coils shown in FIGS. 18 and 24. While four coils 562*a*, 562*b*, 562*c* and 562*d* are shown, greater or fewer numbers of coils could alternatively be provided.

Each coil 562*a*, 562*b*, 562*c* and 562*d* may be connected to another partial turn coil, for example, that may be provided on a circuit board. Each coil 562*a*, 562*b*, 562*c* and 562*d* is provided with wrap around terminal ends 526 that may be surface mounted to the circuit board.

Figure 38:
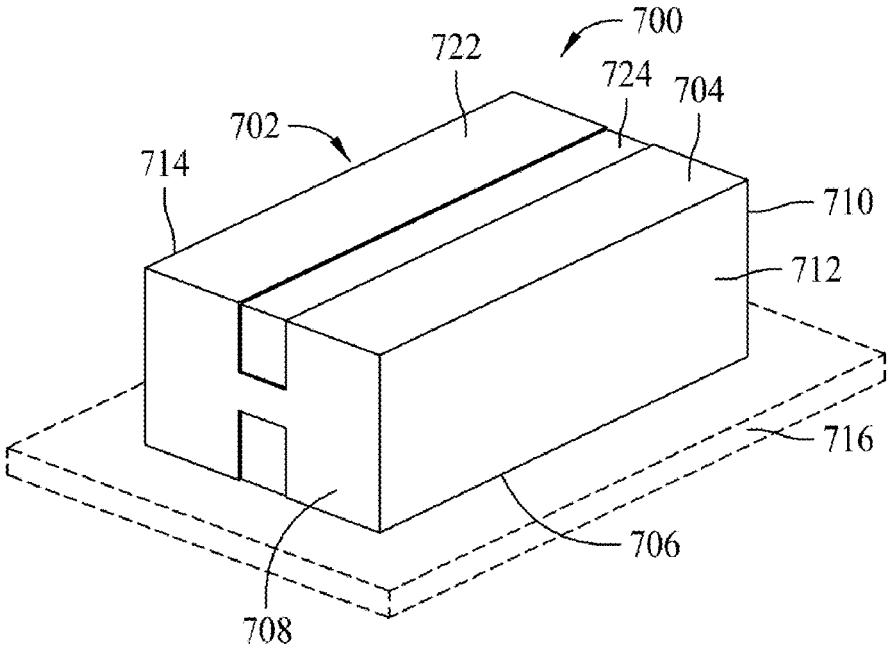
FIG. 38 is a perspective view of another embodiment of a magnetic component.
Figure 39:
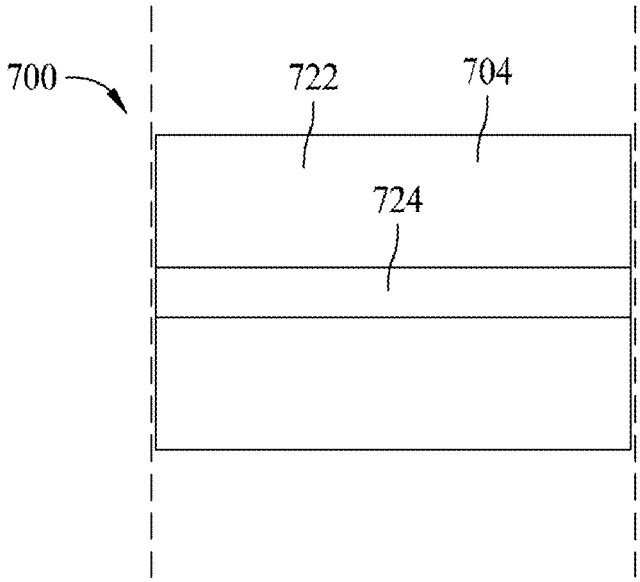
FIG. 39 is a top view of the component shown in FIG. 38.
Figure 40:
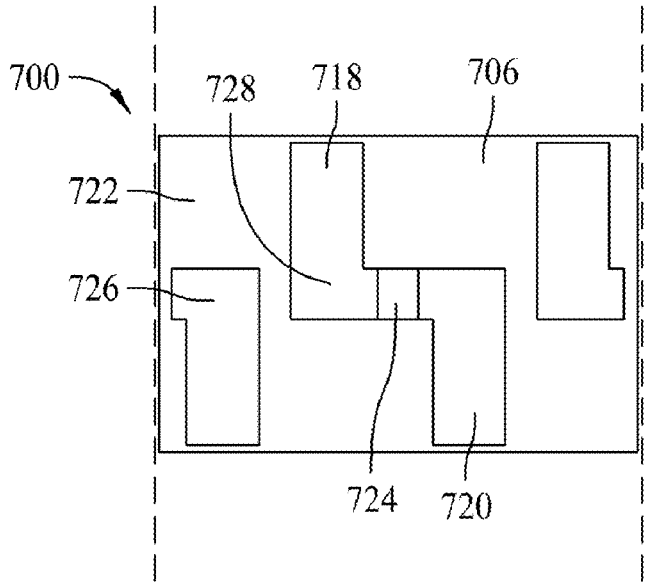
FIG. 40 is a bottom view of the component shown in FIG. 38.

FIG. 38-40 illustrate various views of another exemplary embodiment of a miniaturized magnetic component 700. More specifically, FIG. 38 illustrates the assembly in perspective view, FIG. 39 is a top view, and FIG. 40 is a bottom view.

As shown in the Figures, the assembly 700 includes a generally rectangular magnetic body 702 including a top surface 704, a bottom surface 706 opposing the top surface, opposing end surfaces 708 and 710 interconnecting the top and bottom surfaces 702 and 704, and opposing lateral side surfaces 712, 174 interconnecting the end surface 708, 710 and the top and bottom surface 702, 704. The bottom surface 706 may be placed in abutting contact with and be surface mounted to a circuit board 716 to complete an electrical connection from circuitry on the board 716 to a plurality of coils 718, 720 (FIG. 40) in the magnetic body 702. The coils 718, 720 are arranged in a flux sharing relationship inside the magnetic body 702, and in an exemplary embodiment the magnetic body 702 and associated coils 720 form a coupled power inductor. Each coil 718, 720 may carry a different phase of electrical power.

In an exemplary embodiment, the magnetic body 702 is a monolithic or single piece body fabricated from a material having distributed gap magnetic properties. Any of the magnetic materials discussed above or in the related applications identified herein may be utilized to form the magnetic body, as well as other magnetic materials known in the art if desired. In one example, the magnetic body 702 is fabricated from a moldable material having distributed gap properties and is molded around the coils 718, 720. In another example, magnetic body 702 may be fabricated from a plurality of stacked magnetic sheets such as those described above. Additionally, combinations of different magnetic materials may be utilized to form the one piece magnetic body.

In the example shown in FIGS. 38-40, the magnetic body is fabricated from a first magnetic material 722 having first magnetic properties and a second magnetic material 724 having second magnetic properties. The first magnetic material 722 defines the bulk of the magnetic body 702 in terms of overall size and shape, and the second magnetic material 724 separates portions of the first magnetic material as shown in FIGS. 38-40 and also portions of the coils 718 and 720. By virtue of the different magnetic properties of the second material 724, the second magnetic material 724 effectively forms a magnetic gap between portions of the first the magnetic body and between the adjacent coils 718 and 720, while still maintaining a substantially solid body surrounding the coils 718, 720 without the conventional difficulties of physically gapped, discrete core pieces in a miniaturized assembly. In an exemplary embodiment, the second magnetic material 724 is a magnetic material mixed with a filler material such as an adhesive, such that the second magnetic material has different magnetic properties than the first magnetic material 722. In an exemplary embodiment, the first magnetic material 722 may be used to shape the magnetic body in a first manufacturing step, and the second material may be applied to gaps or cavities formed in the first material to complete the magnetic body 704.

As seen in FIGS. 38-40, the second magnetic material 724 extends to the top surface 704, the bottom surface 706, the opposing end surfaces 708 and 710, and the lateral side surfaces 712, 714 of the magnetic body 702. Additionally, the second magnetic material 724 extends to interior portions of the magnetic body 702 between the coils 718, 720. As seen from FIGS. 38 and 39, the second magnetic material 724 extends in a first plane extending substantially perpendicular to the plane of the circuit board 716 and separates portions of the first magnetic material 722 along the first plane. As seen from FIGS. 38 and 40, the second magnetic material 724 also extends in a second plane extending substantially parallel to the plane of the circuit board 716 and separates portions of the coils 718, and 720 and the first magnetic material 722 in the second plane. That is, the second magnetic material 724 separates the first magnetic material 722 in two intersecting and mutually perpendicular vertical and horizontal planes relative to the circuit board 716.

As shown in FIG. 40, the coils 718, 720 are flat coils, although other types of coils, including any of those described above or in the related applications may be utilized in alternative embodiments. Also, and similar to the embodiment explained above in reference to FIG. 34, each coil 718, 720 may define a first partial number of turns of a winding. The circuit board 716 may include a layout defining a second partial number of turns of a winding. The total number of turns in the completed assembly is the sum of the number of turns provided in the coils 718, 720 and the number of turns provided on the circuit board layout. Various numbers of turns may be provided in such a manner to achieve various objectives.

The coils 718, 720 each include surface mount terminations in the form of contact pads 726, 728 exposed on the bottom surface 706 of the magnetic body 702 for establishing electrical connection to circuitry on the circuit board 716. It is contemplated, however, that other surface mount termination structure may alternatively be utilized, as well as through hole terminations in different embodiments. In the illustrated embodiment, the contact pads 726, 728 define an asymmetrical pattern on the bottom face 706 of the magnetic body, although other patterns or arrangements of surface mount terminations are possible.

The assembly 700 provides numerous advantages over existing power inductors. The magnetic body 702 may be provided in a more compact package with a smaller footprint than assemblies utilizing discrete cores that are physically gapped, while still providing improved inductance values, higher efficiency and increased energy density. AC winding losses may also be considerably reduced relative to conventional inductor assemblies having discrete, physically gapped cores pieces, while still providing adequate control of leakage flux. Additionally, the assembly provides greater freedom in the circuit board layouts utilized to connect to the coils, whereas conventional inductors of this type could only be used with limited types of circuit board layouts. In particular, and unlike conventional power inductors of this type, different phases of electrical power may share the same layout on the circuit board.

Figure 41:
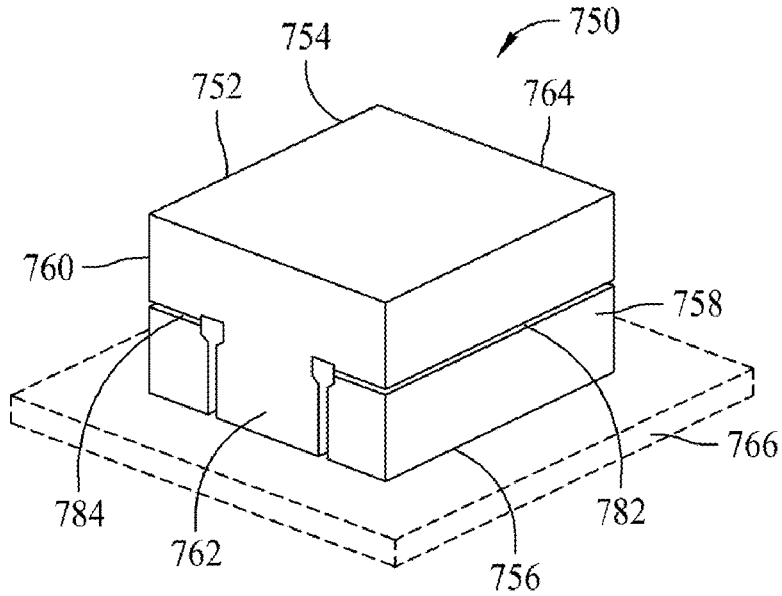
FIG. 41 is a perspective view of another magnetic component.
Figure 42:
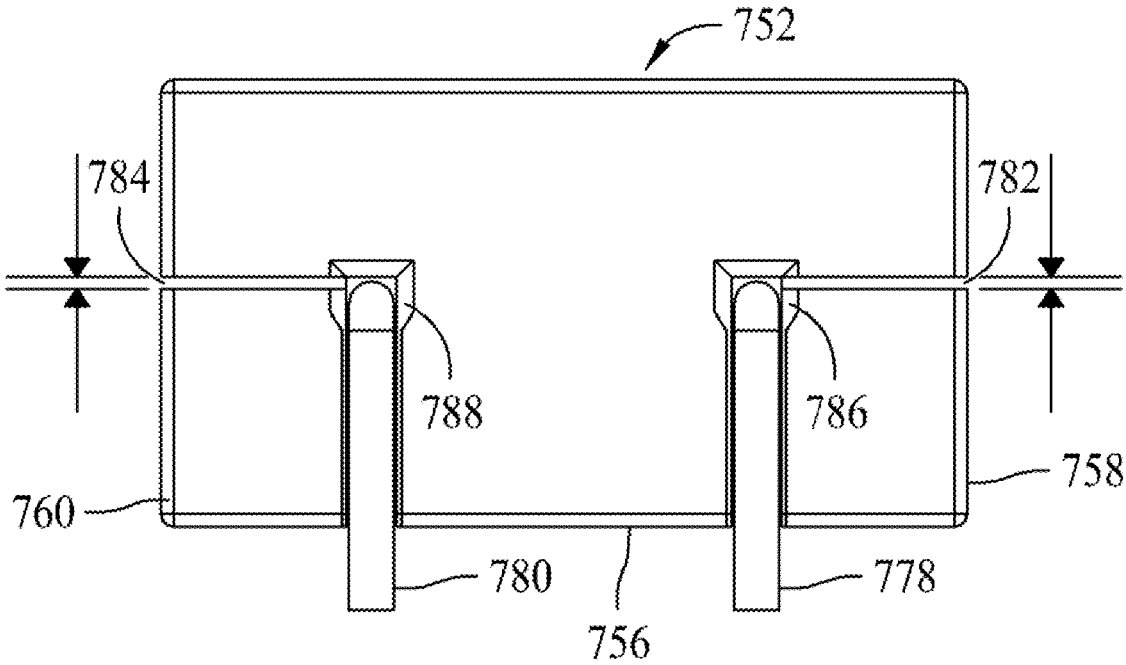
FIG. 42 is a side view of the component shown in FIG. 41.

FIGS. 41 and 42 are a perspective view and a side view, respectively of another embodiment of a magnetic component assembly 750. The assembly 750 includes a magnetic body 752 fabricated from a material having distributed gap properties into a single piece, either via molding or pressing operations as described above. Like the foregoing embodiments, the magnetic body 752 includes a top surface 754, a bottom surface 756, opposing end surfaces 758 and 760, and opposing lateral side surfaces 762 and 764. The bottom surface 756 is placed in abutting contact with a circuit board 766 to complete electrical connection between circuitry on the board 788 to coils 778, 780 in the magnetic body 752.

Unlike the foregoing embodiments, the magnetic body includes physical gaps 782 and 784 formed therein in portions of the magnetic body. In the embodiment shown in FIGS. 41 and 42, the first and second physical gaps 782 and 784 each extend outwardly from a center portion 786, 788 of each of the respective coils 778, 780 to the respective end surfaces 758, 760 of the magnetic body. In the embodiment depicted, the physical gaps 782, 784 extend generally coplanar to one another and substantially parallel to the bottom surface 756 of the magnetic body 752 and hence to the plane of the circuit board 756. Also, in the illustrated embodiment, the physical gaps 782 and 784 do not extend completely around a perimeter of the magnetic body 752. Rather, the gaps 782 and 784 extend only between the coils 778 and 780 and the respective ends 758 and 760 of the magnetic body 752. Neither of the gaps 782 and 784 extend in an interior region of the magnetic body 752 between the coils 778 and 780.

The assembly 750 using the one piece magnetic body 752 and the integrally formed physical gaps 782 and 784 allows desirable properties of physical gaps in an inductor component without assembly challenges of physically gapping discrete core structures.

Figure 43:
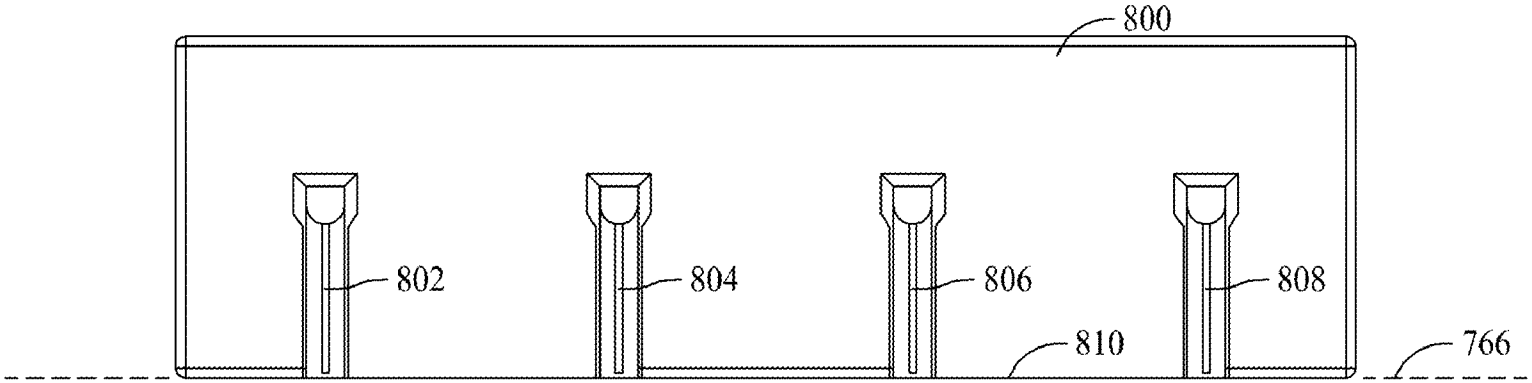
FIG. 43 is a side elevational view of an alternative embodiment of the component shown in FIG. 41 with the coils removed.

FIG. 43 illustrates another embodiment of a magnetic body 800 that may be utilized for an inductor component and utilized with the circuit board 766. The magnetic body 800 is fabricated from a magnetic material having distributed gap properties such as any of the materials described above, and is formed with a series of physical gaps 802, 804, 806 and 808 extending from an interior region of the body to a bottom surface 810 of the body 800 that abuts the circuit board 766. The physical gaps 802, 804, 806 and 808 extend generally parallel to one another and extend in a direction substantially perpendicular to a plane of the circuit board 766.

Figure 44:
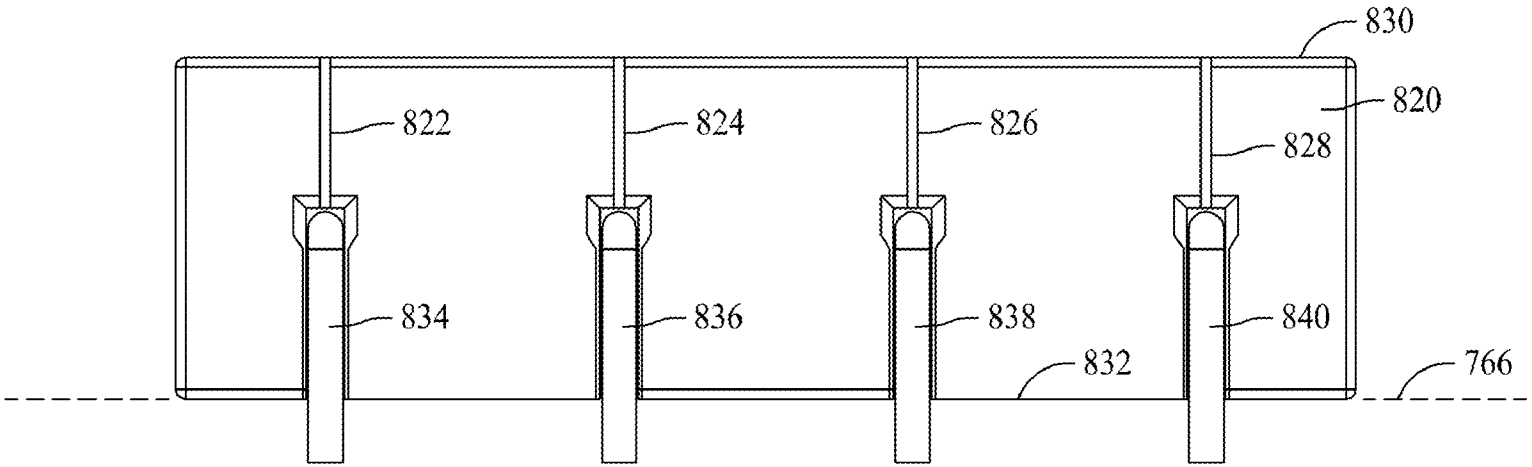
FIG. 44 is a side elevational view of an alternative embodiment of the component shown in FIG. 43.

FIG. 44 shows an another alternative embodiment of am assembly including a magnetic body 820 having a series of physical gaps 822, 824, 826 and 828 extending from an interior region of the body to a top surface 830 of the body opposite a bottom surface 832 of the body 800 that abuts the circuit board 766. As such, the magnetic body 820 is similar to the magnetic body 800 (FIG. 43) but includes physical gaps 822, 824, 826 and 828 extending away from the board 766 instead of toward it. A coil 834, 836, 838 and 840 is associated with each of the gaps 822, 824, 826 and 828.

Figure 45:
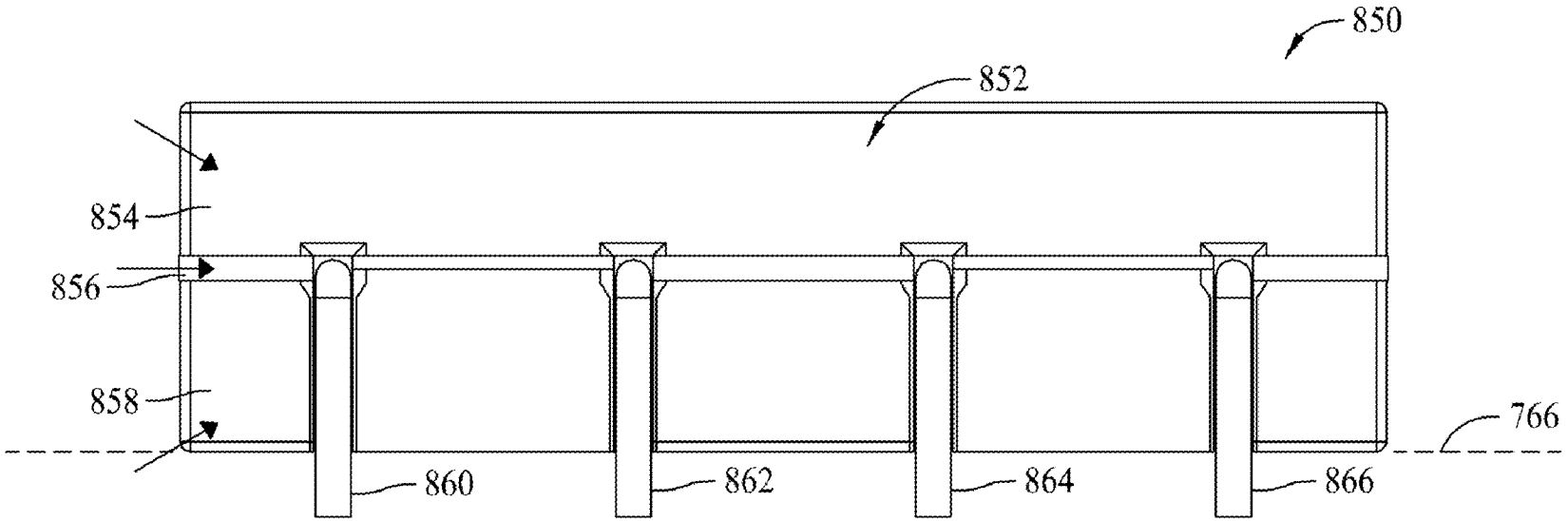
FIG. 45 is a side elevational view of an alternative embodiment of the component shown in FIG. 44.

FIG. 45 is a side elevational view of another embodiment of a magnetic component assembly 850 including a single piece magnetic body 852 fabricated from a first magnetic material 854, a second magnetic material 858 different from the first magnetic material, and a third material 856 different from the first and second magnetic materials. The materials 854, 856 and 858 may be pressed or molded into a single, monolithic piece containing coils 860, 862, 864 and 866 arranged in a flux sharing relationship with one another.

The third material 856 may be a magnetic material or a non-magnetic material in different embodiments, and is interposed between the first magnetic material 854 and the second magnetic material 858. The third material separates the first and second materials 854 and 858 along an entire axial length of the body 852, and also extends between adjacent coils 860 and 862, 862 and 864, and 864 and 866 in interior regions of the body 852. The third material may have, as shown in FIG. 45, a different thickness between adjacent pairs of the plurality of coils to vary the flux paths between the coils 860, 862, 864 and 866.

In various embodiments, one or both of the first and second materials 854 and 858 include stacked magnetic sheets, moldable magnetic powders, combinations of sheets and powders, or other materials known in the art. Each of the first and second materials 854 and 858 may have distributed gap properties of different degree, with the third material 865 having sufficiently distinct properties from either of the first and second materials 854 and 858 to effectively create a magnetic gap between the first and second materials 854 and 858 in an otherwise solid body 852. Difficulties of assembly discrete, physically gapped core pieces are therefore avoided. The electrical performance of the assembly 850 may be varied by adjusting the relative amounts, proportions and dimensions of the first, second and third materials 854, 856 and 858 used to form the single piece body 852. In particular, self inductance and coupled inductance between different phases of electrical power carried by each coil 860, 862, 864 and 866 can be varied with strategic selection of materials, and proportions of those materials to fabricate the body 852.

III. Exemplary Embodiments Disclosed

It should now be evident that the various features described may be mixed and matched in various combinations. For example, where layered constructions are described for the magnetic bodies, non-layered magnetic constructions could be utilized instead. A great variety of magnetic component assemblies may be advantageously provided having different magnetic properties, different numbers and types of coils, and having different performance characteristics to meet the needs of specific applications.

Also, certain of the features described could be advantageously utilized in structures having discrete core pieces that are physically gapped and spaced from another. This is particularly true for the coil coupling features described.

Among the various possibilities within the scope of the disclosure as set forth above, at least the following embodiments are believed to be advantageous relative to conventional inductor components.

An embodiment of a magnetic component assembly is disclosed including a single piece magnetic body fabricated from a material having distributed gap properties and a plurality of coils situated in the magnetic body, wherein the coils are arranged in the magnetic body in a flux sharing relationship with one another.

Optionally, the magnetic body is fabricated from a moldable material having distributed gap properties. The monolithic magnetic body may be fabricated from a first magnetic material having first magnetic properties and a second magnetic material having second magnetic properties, and wherein the second magnetic material separates portions of the first magnetic material and separates a portion of adjacent ones of the plurality of coils. The second magnetic material may separate at least a portion of the first magnetic material and a portion of the coils. The second magnetic material may extend to a top surface, a bottom surface, opposing end surfaces, and lateral side surfaces of the magnetic body.

Also optionally, the single piece magnetic body may be fabricated from a first magnetic material having first magnetic properties and a second magnetic material having second magnetic properties, and wherein the second magnetic material extends in a first plane and in a second plane extending substantially perpendicular to the first plane. One of the first and second magnetic materials comprises pressed magnetic sheets. One of the first and second magnetic materials may also comprise a magnetic powder. At least one of the first and second magnetic materials may be pressed around the plurality of coils. The first magnetic material may form a substantially rectangular body, and the first and second magnetic materials may collectively define a solid body around the coils.

The plurality of coils may optionally be flat coils. Each of the plurality of coils may define a first partial turn of a winding. The assembly may further include a circuit board, wherein the circuit board defines a second partial turn of a winding for each of the plurality of coils, the first and second partial turns being connected to one another.

Surface mount terminations may optionally be provided for each of the plurality of coils. The surface mount terminations may define an asymmetrical pattern on a face of the magnetic body.

A plurality of physical gaps may optionally be formed in the magnetic body. The physical gaps may extend outwardly from a portion of each of the respective plurality of coils to respective end edges of the magnetic body. The assembly may further include a circuit board, and the physical gaps may extend substantially parallel to a plane of the circuit board, and may be spaced apart and generally coplanar to one another. The physical gaps may extend only on respective opposing ends of the magnetic body. The plurality of coils may be spaced apart from one another, and the plurality of physical gaps may not extend between adjacent coils.

Alternatively, the optional physicals gap extend outwardly from each of the respective plurality of coils to a top surface of the magnetic body. The assembly may further include a circuit board, wherein the physical gaps extend substantially perpendicular to a plane of the circuit board. The magnetic body may include a bottom surface, with the bottom surface in abutting contact with the circuit board and the top surface opposing the bottom surface.

The optional physical gaps may alternatively extend outwardly from each of the respective plurality of coils to a bottom surface of the magnetic body. The assembly may further include a circuit board, with the bottom surface in abutting contact with the circuit board. The physical gaps may extend substantially perpendicular to a plane of the circuit board. The physical gaps may include a plurality of spaced apart and substantially parallel gaps.

The magnetic body may optionally include a first magnetic material, a second magnetic material different from the first magnetic material and a third material different from the first and second magnetic materials. The third material may be magnetic. The third material may be interposed between the first and second magnetic materials. The third material may have a different thickness between adjacent pairs of the plurality of coils. The first, second, and third materials may be pressed to one another. At least one of the first and second materials may comprise stacked magnetic sheets. At least one of the first and second materials may comprise moldable magnetic powder. The first and second magnetic materials may have distributed gap properties.

The magnetic body and coils may form a coupled power inductor. Each of the coils may be configured to carry a different phase of electrical power.

IV. Conclusion

The benefits of the invention are now believed to be evident from the foregoing examples and embodiments. While numerous embodiments and examples have been specifically described, other examples and embodiments are possible within the scope and spirit of the exemplary devices, assemblies, and methodology disclosed.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A magnetic component assembly comprising:

a single piece magnetic body fabricated entirely from at least one moldable magnetic material having distributed gap properties; and a plurality of preformed coils embedded in the magnetic body, each coil comprising a first surface mount terminal, a second surface mount terminal, and a winding therebetween;

wherein the plurality of coils are arranged within the magnetic body in a flux sharing relationship with one another, and wherein the magnetic body and plurality of coils form a coupled power inductor wherein each coil is respectively connectable to a different phase of electrical power, wherein self-inductance and coupled inductance between different phases of electrical power carried by the respective plurality of coils is provided; and wherein the at least one moldable magnetic material includes a first magnetic material having first magnetic properties and a second magnetic material having second magnetic properties, the second magnetic properties being different: from the first magnetic properties.

2. The magnetic component assembly of claim 1, wherein the second magnetic material separates at least a portion of the first magnetic material and a portion of each of the plurality of preformed coils.

3. The magnetic component assembly of claim 1, wherein the second magnetic material extends to a top surface, a bottom surface, opposing end surfaces, and lateral side surfaces of the magnetic body.

4. The magnetic component assembly of claim 1, wherein the second magnetic material extends in a first plane and in a second plane extending substantially perpendicular to the first plane.

5. The magnetic component assembly of claim 1, wherein the at least one moldable magnetic material comprises a plurality of pressed magnetic sheets.

6. The magnetic component assembly of claim 4 wherein one of the first and second magnetic materials comprises a magnetic powder.

7. The magnetic component assembly of claim 4, wherein at least one of the first and second magnetic materials is pressed around the plurality of preformed coils.

8. The magnetic component assembly of claim 4, wherein the first and second magnetic materials collectively define a solid body around the plurality of preformed coils.

9. The magnetic component assembly of claim 1, wherein the plurality of preformed coils are flat coils.

10. The magnetic component assembly of claim 1, wherein each of the plurality of preformed coils each respectively defines a first partial turn of a winding.

11. The magnetic component assembly of claim 10, further comprising a circuit board, wherein the circuit board defines a second partial turn of a winding for each of the plurality of preformed coils, the first and second partial turns being connected to one another.

12. The magnetic component assembly of claim 1, wherein the respective surface mount terminations of the plurality of preformed coils define an asymmetrical pattern on a face of the magnetic body.

13. The magnetic component assembly of claim 1, wherein a plurality of physical gaps are formed in the magnetic body.

14. The magnetic component assembly of claim 13, wherein the plurality of physical gaps extend outwardly from a portion of each of the respective plurality of preformed coils to respective end edges of the magnetic body.

15. The magnetic component assembly of claim 14, wherein the assembly further includes a circuit board, and the plurality of physical gaps extend substantially parallel to a plane of the circuit board.

16. The magnetic component assembly of claim 15, wherein the plurality of physical gaps are spaced apart and generally coplanar to one another.

17. The magnetic component assembly of claim 16, wherein the plurality of physical gaps extend only on the respective opposing ends of the magnetic body.

18. The magnetic component assembly of claim 13, wherein the plurality of preformed coils are spaced apart from one another, and the plurality of physical gaps do not extend between adjacent coils.

19. The magnetic component assembly of claim 13, wherein the physical gaps extend outwardly from each of the respective plurality of preformed coils to a top surface of the magnetic body.

20. The magnetic component assembly of claim 19, further comprising a circuit board, wherein the physical gaps extend substantially perpendicular to a plane of the circuit board.

21. The magnetic component assembly of claim 20, the bottom surface of the magnetic body in abutting contact with the circuit board and the top surface opposing the bottom surface.

22. The magnetic component assembly of claim 13, wherein the physical gaps extend outwardly from each of the respective plurality of preformed coils to a bottom surface of the magnetic body.

23. The magnetic component assembly of claim 22, further comprising a circuit board, the bottom surface of the magnetic body in abutting contact with the circuit board.

24. The magnetic component assembly of claim 23, wherein the physical gaps extend substantially perpendicular to a plane of the circuit board.

25. The magnetic component assembly of claim 13, wherein the physical gaps comprises a plurality of spaced apart and substantially parallel gaps.

26. The magnetic component assembly of claim 1, wherein the at least one moldable magnetic material further includes a third magnetic material different from the first and second magnetic materials.

27. The magnetic component assembly of claim 26, wherein the third magnetic material is interposed between the first and second magnetic materials.

28. The magnetic component assembly of claim 26, wherein the third magnetic material has a different thickness between adjacent pairs of the plurality of coils.

29. The magnetic component assembly of claim 26, wherein the first, second, and third magnetic materials are pressed to one another.

30. The magnetic component assembly of claim 26, wherein at least one of the first and second magnetic materials comprises stacked magnetic sheets.

31. The magnetic component assembly of claim 27, wherein at least one of the first and second magnetic materials comprises moldable magnetic powder.

32. The magnetic component assembly of claim 26, wherein the first and second magnetic materials have distributed gap properties.

33. A magnetic component assembly comprising:

a single piece magnetic body fabricated from a moldable magnetic material having distributed gap properties, the single piece magnetic body having a top surface, a bottom surface, opposing end surfaces interconnecting the top and bottom surfaces, and opposing lateral side surfaces interconnecting the top surface, the bottom surface and the opposing end surfaces; and a plurality of preformed coils, each of the plurality of preformed coils comprising a first terminal for connection to a circuit board, a second terminal for connection to a circuit board, and a winding between the first and second terminals;

wherein the winding of each of the plurality of preformed coils is embedded in the magnetic body and the plurality of coils are spaced from one another in an axial direction extending parallel to the opposing lateral side surfaces and perpendicular to the opposing end surfaces;

wherein the moldable magnetic material includes a first magnetic material having first magnetic properties and a second magnetic material having second magnetic properties, the second magnetic properties being different from the first magnetic properties.

34. The magnetic component assembly of claim 33, wherein the plurality of coils are arranged within the magnetic body in a flux sharing relationship with one another, and wherein the magnetic body and plurality of coils form a coupled power inductor wherein each coil is respectively connectable to a different phase of electrical power, wherein self inductance and coupled inductance between different phases of electrical power carried by the respective plurality of coils is provided.

* * * * *